US007684747B2

(12) United States Patent
Yamana

(10) Patent No.: US 7,684,747 B2
(45) Date of Patent: Mar. 23, 2010

(54) IMAGE FORMING APPARATUS

(75) Inventor: Shinji Yamana, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 536 days.

(21) Appl. No.: 11/723,364

(22) Filed: Mar. 19, 2007

(65) Prior Publication Data

US 2007/0217840 A1 Sep. 20, 2007

(30) Foreign Application Priority Data

Mar. 17, 2006 (JP) ..... P2006-075482

(51) Int. Cl.
*G03G 15/20* (2006.01)

(52) U.S. Cl. ..... 399/340; 399/341

(58) Field of Classification Search ..... 399/1, 399/2, 148, 222, 339, 340, 341
See application file for complete search history.

(56) References Cited

U.S. PATENT DOCUMENTS 5,738,967 A 4/1998 Horii et al.
7,046,952 B2 * 5/2006 Kurotori et al. ..... 399/340

FOREIGN PATENT DOCUMENTS

| | | | |
|---|---|---|---|
| JP | 57186784 A | * | 11/1982 |
| JP | 2-167761 | | 6/1990 |
| JP | 9-62109 | | 3/1997 |
| JP | 9-216351 | | 8/1997 |
| JP | 9-216453 | | 8/1997 |
| JP | 2000-168058 | | 6/2000 |

* cited by examiner

*Primary Examiner*—David M Gray
*Assistant Examiner*—Barnabas T Fekete
(74) *Attorney, Agent, or Firm*—Nixon & Vanderhye, P.C.

(57) ABSTRACT

In an image forming apparatus including a toner image forming section, a transfer section, a recording medium supplying section, and a control unit, an image forming unit that forms, for example, a yellow toner image causes liquid-repellent particles to be adhered onto a part of a photoreceptor drum other than an electrostatic latent image, causes fixing fluid to be adhered onto a part of the electrostatic latent image such that only the fixing fluid is transferred onto an image forming roller, and causes the fixing fluid to be supplied on the image forming roller.

10 Claims, 9 Drawing Sheets

IMAGE FORMING APPARATUS

CROSS-REFERENCE TO RELATED APPLICATION

This application claims priority to Japanese Patent Application No. 2006-75482, which was filed on Mar. 17, 2006, the contents of which, are incorporated herein by reference, in their entirety.

BACKGROUND OF THE INVENTION

1. Field of the Invention

The present invention relates to an image forming apparatus.

2. Description of the Related Art

An electrophotographic method has been widely adopted in known image forming apparatuses, such as a copying machine, a printer, and a facsimile. In the electrophotographic method, it is general that a photoreceptor having a photosensitive layer, which includes photoconductive substances, formed on a surface thereof is used, charges are applied to the surface of the photoreceptor in order to uniformly charge the surface of the photoreceptor, an electrostatic latent image corresponding to image information is formed in various kinds of image forming processes, the electrostatic latent image is developed with a developer containing toner supplied from a developing section so as to make a toner image, and the toner image is directly transferred onto a recording medium, such as paper, or is first transferred onto an intermediate transfer medium and is then transferred onto a recording medium to thereby form an image. In addition, in order to fix the toner image, which is transferred onto a recording medium, on the recording medium, it is general to apply heat and pressure to the recording medium by a fixing section in a heat fixing method, such as a developing roller. In the heat fixing system, it is necessary to heat toner at high temperature of about 150° C. in order to soften and fuse the toner by using a heating apparatus, such as a heater. Accordingly, the power consumption increases. It is a present condition that about a half or more of total power consumption in an electrophotographic image forming apparatus occurs due to the heat fixing. On the other hand, energy saving activities have been progressing to stop global warming. This is also related to universal use of electrophotographic image forming apparatuses. Accordingly, even in the electrophotographic image forming apparatuses, it is requested to reduce the power consumption.

As a solution to the problem described above, there is known a wet fixing method of using a fixing fluid containing water and liquid that can be dissolved or dispersed in water and act to soften or swell toner or resin components of toner. In the wet fixing method, a softened or swollen toner image is adhered onto a recording medium by supplying the fixing fluid and then the toner image is fixed onto the recording medium by applying pressure. Since toner is softened or swollen due to a fixing fluid and is then fixed in the wet fixing method, the power consumption in the wet fixing method is much smaller than that in the heat fixing method. For this reason, various kinds of proposals for improvements of the wet fixing method have been made. For example, there has been proposed an electrophotographic image forming apparatus that has a toner image forming section and has a configuration in which a toner image formed by the toner image forming section is directly transferred onto a recording medium or transferred onto the recording medium through an intermediate transfer medium (for example, refer to Japanese Unexamined Patent Publication JP-A 2-167761 (1990)).

In the image forming apparatus, the toner image forming section includes a fixing fluid holding member, a fixing fluid supplying section, and developing section. In addition, an image composed of a fixing fluid corresponding to image information is formed on the fixing fluid holding member by means of the fixing fluid supplying section, and a toner image is formed by supplying toner to the image by means of the developing section. Further, there has been proposed an image forming method in which an image is formed by discharging liquid having viscosity onto a recording medium in an inkjet method in accordance with image information and then a final image is formed by adhering a coloring agent onto the image (for example, refer to Japanese Unexamined Patent Publication JP-A 9-216351 (1997)). Furthermore, there has been proposed an image forming method in which an image is formed by discharging a fixing fluid onto a recording medium in an inkjet method in accordance with image information and then a final image is formed by adhering toner onto the image (for example, refer to Japanese Unexamined Patent Publication JP-A 9-216453 (1997)). Furthermore, there has been proposed an image forming apparatus which has an inkjet type fixing fluid supplying section and a developing section and in which liquid droplets are discharged from the inkjet type fixing fluid supplying section onto a recording medium or an intermediate transfer medium in accordance with image information so as to form an image composed of a fixing fluid on the recording medium or the intermediate transfer medium and then toner is supplied to the image by means of the developing section so as to form a toner image (for example, refer to Japanese Unexamined Patent Publication JP-A 2000-168058). The image forming apparatus includes a toner removing section for attracting and removing toner, which is excessively supplied from the developing section onto the recording medium or the intermediate transfer medium, by an electrostatic force and a toner recovering section for returning toner removed by the toner removing section to the developing section.

In the known techniques described above, the fixing fluid is supplied to a recording medium or the like by using the inkjet method. However, in order to do so, it is necessary to lower the viscosity of the fixing fluid and to make an adjustment to a viscosity range where the fixing fluid can be discharged in the inkjet method. In addition, in the case of causing a fixing fluid having low viscosity to be adhered onto a recording medium, such as normal paper, the fixing fluid permeates into a part (non-image part) other then a corresponding image in a region where the fixing fluid image is formed. As a result, blur easily occurs. In addition, since the entire fixing fluid that is supplied cannot be used to soften and swell toner, an efficiency of transfer of a toner image onto a recording medium or the like is worse. In the case of raising the viscosity in order to prevent the permeation of the fixing fluid, it takes time to discharge the fixing fluid by using the inkjet method. Moreover, there is no explanation on a practical and effective method for preventing toner from permeating into or being adhered onto a non-image part when forming a fixing fluid image corresponding to image information other than a solid image.

Further, there has been proposed an image forming apparatus that includes a photoreceptor that bears an electrostatic latent image on a surface thereof, a developing roller that supplies toner to the photoreceptor, an electric potential applying roller that forms a liquid developer layer, in which toner is dispersed in insulating liquid, on a surface of the developing roller, and a developer tank that supplies liquid developer to the electric potential applying roller and performs liquid development (for example, refer to Japanese Unexamined Patent Publication JP-A 9-62109 (1997)). The liquid developer is adhered onto a surface of the electric potential applying roller when the electric potential applying roller is rotated under a state in which a part of the electric potential applying roller is immersed in the liquid developer contained in the developer tank. Then, the electric potential applying roller applies an electric potential to the liquid developer so as to charge toner in the liquid developer with an electric potential higher than the surface of the developing roller. Then, toner and insulating liquid adhered onto the toner in a part where the electric potential applying roller and the developing roller are positioned to be closest to each other are adhered onto the surface of the developing roller due to an electrophoretic phenomenon, such that a liquid developer layer is formed on the surface of the developing roller. In a part where the developing roller and the photoreceptor are positioned to be closest to each other, toner is supplied from the liquid developer layer of the developing roller to an electrostatic latent image on the photoreceptor, and thus the electrostatic latent image is developed. In order to perform electrophoresis by charging toner like liquid developing, a large amount of insulating non-aqueous solvent should be used. However, in the case of using a large amount of non-aqueous solvent, it is necessary to prepare a container, which is used to recover the non-aqueous solvent, inside the image forming apparatus, which causes increase in the size of an image forming apparatus. In addition, since the non-aqueous solvent smells very bad, it is not possible to prevent bad smell from leaking. Accordingly, it is difficult to dispose an image forming apparatus that performs liquid developing within doors.

SUMMARY OF THE INVENTION

An object of the invention is to provide an image forming apparatus which is capable of selectively supplying a fixing fluid to only a part of an electrostatic latent image, has high efficiency of transferring toner onto a recording medium or the like, hardly causes blur, and is capable of forming an image in a speed higher than that of a known image forming apparatus that uses a fixing fluid and of being manufactured with low costs.

The invention provides an image forming apparatus comprising:

a toner image forming section for forming a toner image; and a transfer section for transferring the toner image onto a recording medium directly or through an intermediate transfer medium, wherein the toner image forming section includes an image bearing member that bears an electrostatic latent image thereon;

an electrostatic latent image forming section for forming the electrostatic latent image on the image bearing member;

a liquid-repellent particle supplying section for supplying liquid-repellent particles to a region excluding the electrostatic latent image in a region on the image bearing member where the electrostatic latent image is formed, the liquid-repellent particles being particles having a liquid-repellent property with respect to fixing fluid that acts to swell or soften toner;

a fixing fluid supplying section for supplying the fixing fluid to a region corresponding to the electrostatic latent image in the region on the image bearing member where the electrostatic latent image is formed; and a developing section for forming a toner image by supplying toner to a region, to which the fixing fluid is supplied, on the image bearing member.

According to the invention, there is provided an image forming apparatus including a toner image forming section and a transfer section, the toner image forming section including an image bearing member, an electrostatic latent image forming section, a liquid-repellent particle supplying section, a fixing fluid supplying section, and a developing section. In the image forming apparatus of the invention, a configuration is adopted in which the liquid-repellent particles, which are particles having a liquid-repellent property with respect to fixing fluid, are supplied to a part (part around the electrostatic latent image) excluding the electrostatic latent image in the region on the image bearing member where the electrostatic latent image is formed by the liquid-repellent particle supplying section and then the fixing fluid is supplied to the part of the electrostatic latent image by the fixing fluid supplying section. Accordingly, even when the fixing fluid is adhered onto the part other than the electrostatic latent image, the fixing fluid is repelled by the liquid-repellent particles. As a result, the fixing fluid can be selectively supplied to only the part of the electrostatic latent image. In addition, since there is adopted a configuration in which the fixing fluid is supplied and then toner is supplied, the fixing fluid does not exist on toner adhered on the liquid-repellent particles, even if a surface of toner adhered onto the fixing fluid swells and softens to show the viscosity. Accordingly, the toner adhered on the liquid-repellent particles does not the viscosity. Thus, a part where the fixing fluid exist, that is, only toner in a part of an electrostatic latent image swells and softens so as to be reliably fixed. In this state, when the toner is transferred onto a recording medium, the toner is transferred with high efficiency. As a result, a high-density image in which an electrostatic latent image is reliably reproduced is obtained. Further, since toner around the image is not transferred and fixed onto the recording medium, it is possible to prevent blur from occurring. In addition, since there is no operation that requires time, such as forming of a fixing fluid image in an inkjet method and electrophoresis of toner in a liquid developing method, the image forming speed is faster than that in the methods. In addition, it is not necessary to use a large amount of solvent in order to reduce the viscosity of fixing fluid or perform electrophoresis of toner. Moreover, in the configuration according to the aspect of the invention, since fixing fluid having water as solvent is used, a bad smell occurs little. Accordingly, a measure for disposal, a measure taken against the bad smell, and the like are not needed because organic solvents are not used. As a result, a manufacturing cost of an image forming apparatus is also reduced.

In the invention, it is preferable that the image bearing member is a photoreceptor, and the electrostatic latent image forming section includes a charging section for charging a surface of the photoreceptor, and an exposure section for exposing the surface of the charged photoreceptor to signal light corresponding to image information so as to form an electrostatic latent image.

According to the invention, a dry electrophotographic technique is used in which the photoreceptor is used as an image bearing member, a surface of the photoreceptor is charged by the charging section, and the charged surface of the photoreceptor is exposed to the signal light corresponding to the image information by the exposure section so as to form the electrostatic latent image. It is possible to cause liquid-repellent particles to be selectively adhered around an image to be formed in high speed. As a result, it is also possible to increase the image forming speed.

Furthermore, in the invention, it is preferable that the toner image forming section includes a fixing fluid recovering section provided between the fixing fluid supplying section and the developing section, for selectively recovering only fixing fluid adhered onto liquid-repellent particles on the image bearing member.

According to the invention, a fixing fluid recovering section is provided between the fixing fluid supplying section and the developing section in order to recover only the fixing fluid adhered onto liquid-repellent particles on the image bearing member. As a result, it is possible to more reliably prevent blur from occurring.

Furthermore, in the invention it is preferable that the toner image forming section further includes a fixing fluid holding section for holding fixing fluid that is selectively transferred thereonto from the image bearing member, and the developing section causes toner to be supplied to the fixing fluid on the fixing fluid holding section so as to form a toner image.

According to the invention, by adopting a configuration in which the fixing fluid holding section for holding transferred fixing fluid on a surface thereof after fixing fluid adhered on a part of an electrostatic latent image of the image bearing member is transferred thereonto is provided and toner from the developing section is supplied to the fixing fluid on the fixing fluid holding section, a stripping property of a recording medium after transferring the toner image onto the recording medium is improved. The stripping property of the recording medium with respect to a toner image transferred body obtained by transferring a toner image is much better in a case of transfer using the fixing fluid holding section than in a case of direct transferring from the image bearing member. In addition, in the case when fixing fluid that is adhered between liquid-repellent particles (non-adhesion part) in various forms is transferred onto the fixing fluid holding section, the fixing fluid becomes a circular dot due to the surface tension. As a result, the image quality is improved. In addition, in the case of forming a rubber layer on a surface layer of the fixing fluid holding section, a property of following the recording medium is improved. As a result, the efficiency of transfer of toner, which is swollen and softened due to coming in contact with fixing fluid, into a recording medium can be easily improved.

Furthermore, in the invention, it is preferable that the developing section supplies charged toner to the fixing fluid on the image bearing member or the fixing fluid holding section.

According to the invention, by supplying the charged toner to the fixing fluid on the image bearing member or the fixing fluid holding section, a rate of selective adhesion of toner onto fixing fluid further increases, and occurrence of blur is further prevented.

Furthermore, in the invention, it is preferable that the developing section is provided to be spaced apart from the image bearing member or the fixing fluid holding section with a gap therebetween.

According to the invention, by providing the developing section so as to be spaced apart from the image bearing member or the fixing fluid holding section with a gap therebetween, the fixing fluid is prevented from adhering onto the developing section and the toner is prevented from fixing in the developing section.

Furthermore, in the invention, it is preferable that the fixing fluid holding section includes a drying section for drying fixing fluid on the fixing fluid holding section and toner that is swollen or softened by the fixing fluid.

According to the invention, by providing a drying section for drying the fixing fluid on the fixing fluid holding section and the swollen or softened toner, the toner is appropriately dried during a period of time from when the toner is supplied onto the fixing fluid to swell or soften to when the toner is transferred onto a recording medium. Accordingly, the viscosity of toner is improved and the efficiency of transfer of toner onto the recording medium is greatly improved.

Furthermore, in the invention, it is preferable that the drying section is a heating section for heating the fixing fluid holding section to a temperature equal to or larger than a glass transition temperature of toner.

According to the invention, as the drying section, there is used a heating section for heating the fixing fluid holding section to a temperature equal to or larger than the glass transition temperature of toner. Accordingly, it is possible to greatly reduce blur occurring when blurred toner is adhered onto the fixing fluid holding section to be then transferred and fixed on a recording medium.

Furthermore, in the invention, it is preferable that the transfer section transfers a toner image formed by toner that is swollen or softened by the fixing fluid on the fixing fluid holding section, onto an intermediate transfer medium or a recording medium, and the toner image forming section includes a toner recovering section for recovering toner remaining on the fixing fluid holding section after transferring the toner image onto the intermediate transfer medium or the recording medium.

According to the invention, by providing a toner recovering section for recovering toner remaining on a surface of the fixing fluid holding section after transferring the toner image from the fixing fluid holding section onto the intermediate transfer medium or the recording medium, it becomes possible to keep the surface of the fixing fluid holding section clean all the time and to further prevent defect image due to blur or the like from occurring.

Furthermore, in the invention, it is preferable that a toner image forming section includes a plurality of image forming units for forming toner images having different colors, and a multi colored image is formed by transferring and overlaying the toner images having different colors which are formed in each image forming unit onto a recording medium or an intermediate transfer medium.

In the invention, by forming the multi colored image by overlaying the plurality of toner images having different colors on the recording medium or the intermediate transfer medium, it becomes easy to uniformly form the respective toner images to be thin. As a result, a high-quality multi colored image is obtained.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
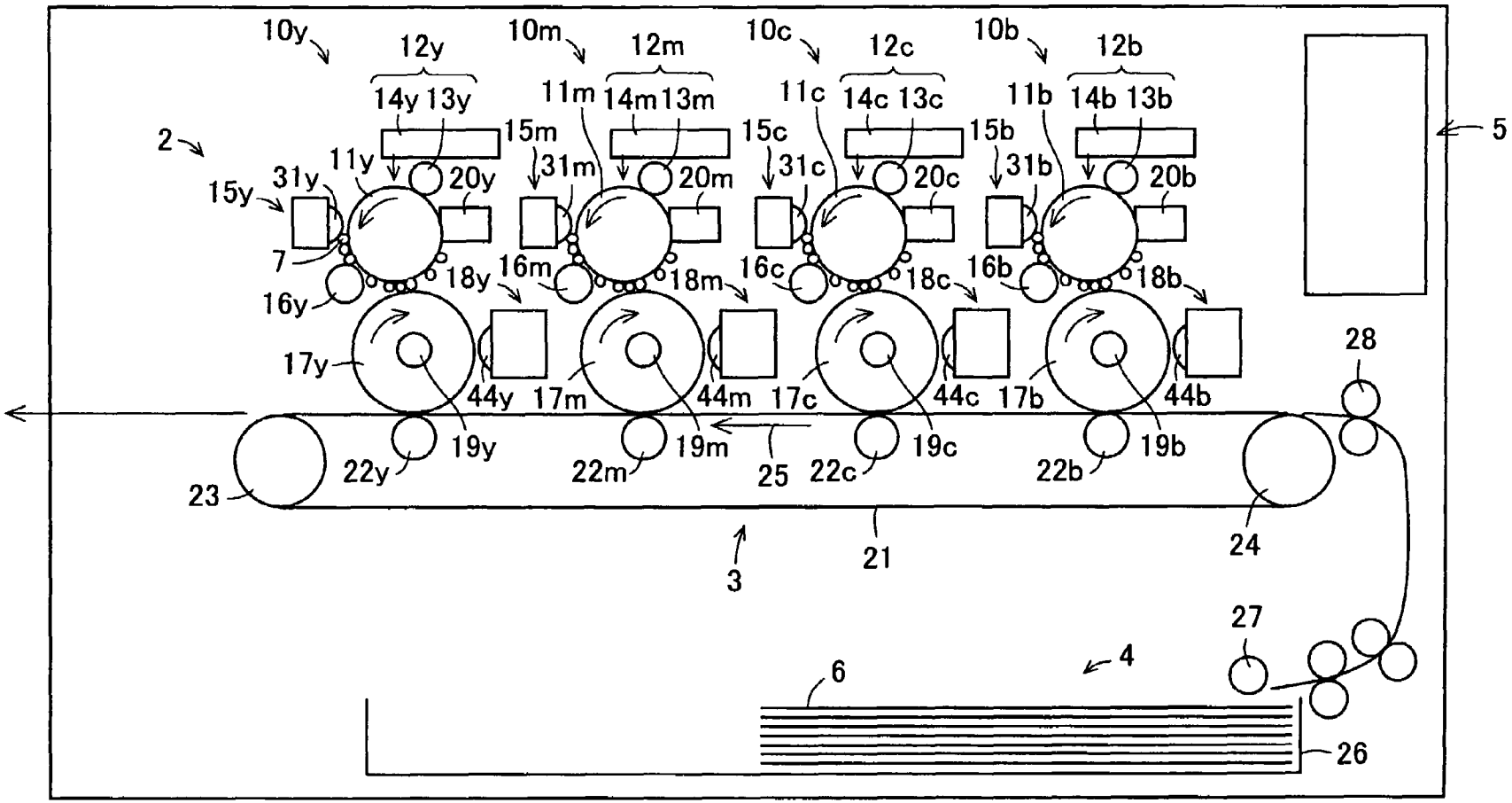
FIG. 1 is a cross-sectional view schematically illustrating the configuration of an image forming apparatus according to a first embodiment of the invention.

Now referring to the drawings, preferred embodiments of the invention are described below.

Figure 2:
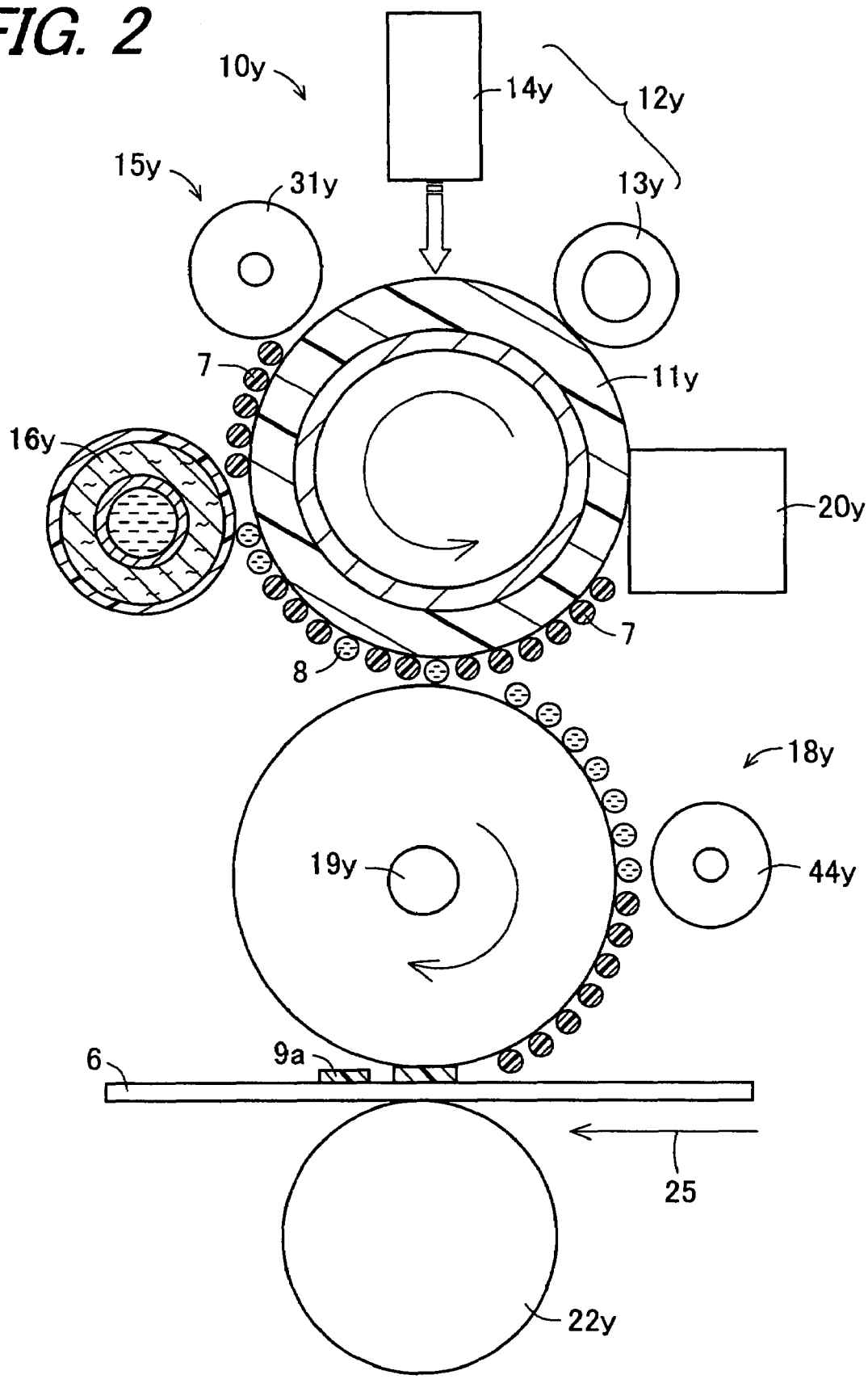
FIG. 2 is a cross-sectional enlarged view illustrating the configuration of a main part of the image forming apparatus shown in FIG. 1.
Figure 3:
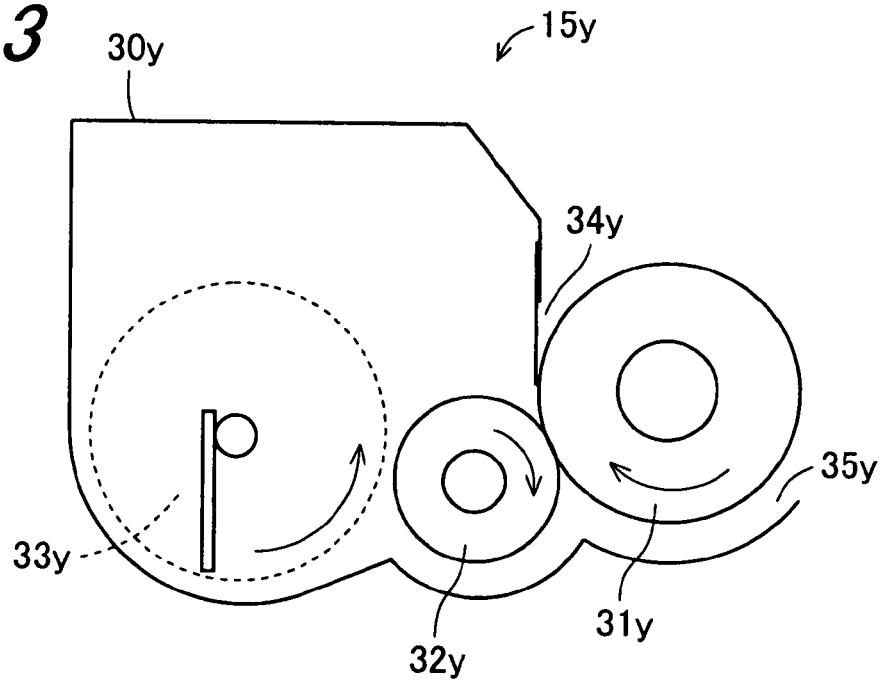
FIG. 3 is a cross-sectional view schematically illustrating the configuration of a liquid-repellent particle supplying section.
Figure 4:
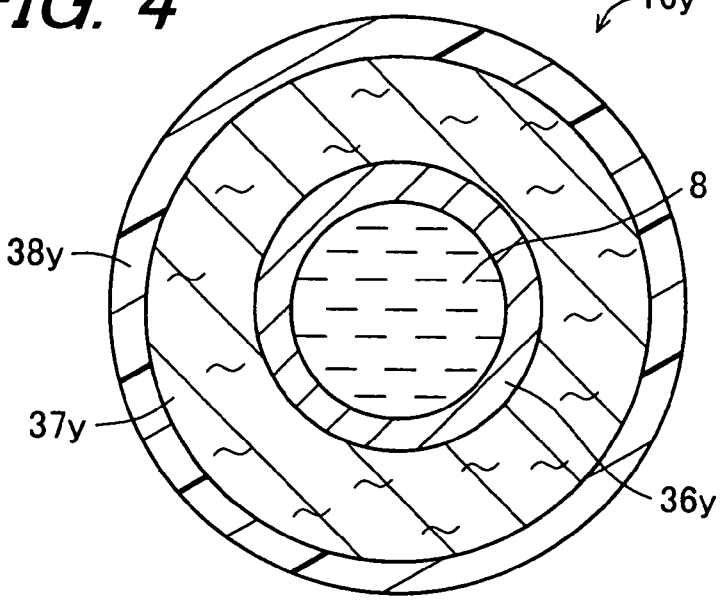
FIG. 4 is a cross-sectional view schematically illustrating the configuration of a fixing fluid supplying section.
Figure 5:
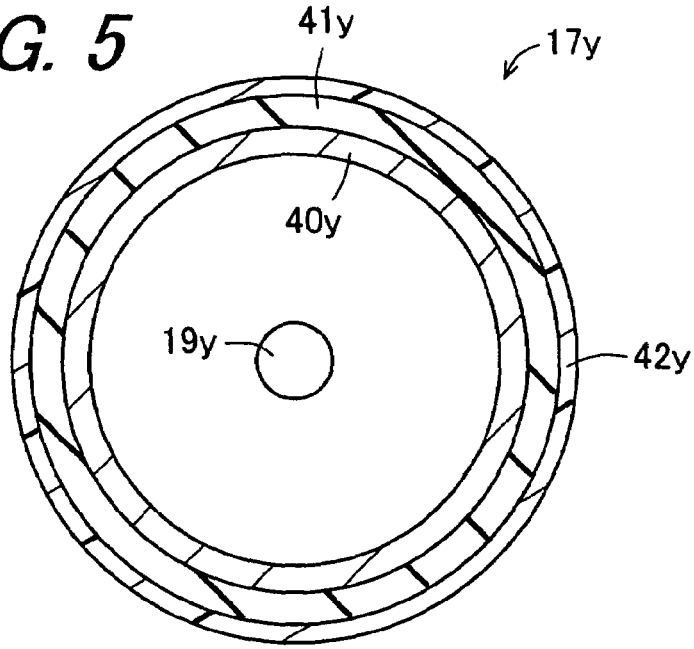
FIG. 5 is a cross-sectional view schematically illustrating the configuration of an image forming roller.
Figure 6:
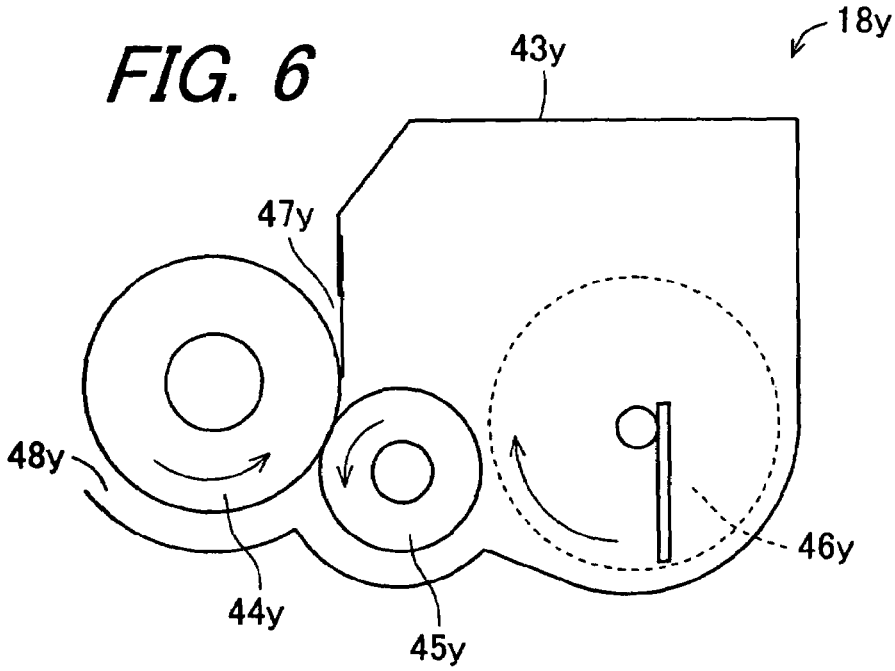
FIG. 6 is a cross-sectional view schematically illustrating the configuration of a developing section.

FIG. 1 is a cross-sectional view schematically illustrating the configuration of an image forming apparatus 1 according to a first embodiment of the invention. FIG. 2 is a cross-sectional enlarged view illustrating the configuration of a main part (a toner image forming section 2) of the image forming apparatus 1 shown in FIG. 1. FIG. 3 is a cross-sectional view schematically illustrating the configuration of a liquid-repellent particle supplying section 15*y* used in the image forming apparatus 1 shown in FIG. 1. FIG. 4 is a cross-sectional view schematically illustrating the configuration of a fixing fluid supplying section 16*y* used in the image forming apparatus 1 shown in FIG. 1. FIG. 5 is a cross-sectional view schematically illustrating the configuration of an image forming roller 17*y* used in the image forming apparatus 1 shown in FIG. 1. FIG. 6 is a cross-sectional view schematically illustrating the configuration of a developing section 18*y* used in the image forming apparatus 1 shown in FIG. 1. The image forming apparatus 1 is a tandem-type image forming apparatus that transfers toner images by sequentially overlaying the images having different colors of black, cyan, yellow, and magenta on a recording medium 6. The image forming apparatus 1 includes the toner image forming section 2, a transfer section 3, a recording medium supplying section 4, and a control unit 5.

The toner image forming section 2 includes image forming units 10*b*, 10*c*, 10*m*, and 10*y*. The image forming units 10*b*, 10*c*, 10*m*, and 10*y* are arranged in a row and in this order from the rotational driving direction (sub-scanning direction) of a recording medium conveying belt 21 (will be described later), that is, from an upstream side of the direction indicated by an arrow 25. The image forming units 10*b*, 10*c*, 10*m*, and 10*y* form electrostatic latent images corresponding to image information of respective colors inputted as digital signals or the like. In addition, the image forming units 10*b*, 10*c*, 10*m*, and 10*y* supply toners having colors corresponding to the respective electrostatic latent images and then form toner images corresponding to the respective colors by means of development. The image forming unit 10*b* forms a toner image corresponding to image information of black, the image forming unit 10*c* forms a toner image corresponding to image information of cyan, the image forming unit 10*m* forms a toner image corresponding to image information of magenta, and the image forming unit 10*y* forms a toner image corresponding to image information of yellow. The image forming unit 10*y* includes-a photoreceptor drum 11*y*, an electrostatic latent image forming section 12*y*, the liquid-repellent particle supplying section 15*y*, the fixing fluid supplying section 16*y*, the image forming roller 17*y* serving as the fixing fluid holding section, the developing section 18*y*, and a liquid-repellent particle recovering section 20*y*. The electrostatic latent image forming section 12*y*, the liquid-repellent particle supplying section 15*y*, the fixing fluid supplying section 16*y*, the image forming roller 17*y*, and the liquid-repellent particle recovering section 20*y* are arranged around the photoreceptor drum 11*y* in this order from an upstream side of the rotation direction of the photoreceptor drum 11*y*.

The photoreceptor drum 11*y* is a memory that is supported to be rotated around its axis by a driving mechanism (not shown) and has a photosensitive layer on which an electrostatic latent image is formed. For example, the photoreceptor drum 11*y* includes a conductive substrate and a photosensitive layer formed on a surface of the conductive substrate. As the conductive substrate, it is possible to use a conductive substrate having a cylindrical, columnar, or sheet shape. Among the conductive substrates having the cylindrical, columnar, or sheet shapes, it is preferable to use the conductive substrate having the cylindrical shape. For example, an aluminum pipe may be used as the cylindrical shaped conductive substrate. In addition, an organic photosensitive layer, an inorganic photosensitive layer, or the like may be used as the photosensitive layer. As the organic photosensitive layer, there may be used: a stacked layer obtained by stacking a resin layer (charge generating layer), which includes charge generating substances that generate charges, and a resin layer (charge transporting layer) including charge transporting substances that serve to receive and transport the charges generated by the charge generating substances; and a resin layer including charge generating substances and charge transporting substances in a resin layer. An example of the charge transporting layer includes a charge transporting layer that has charge transporting substances, silicon-based leveling agent, and binder as essential components and contains known plasticizer or sensitizer as needed.

Known substances may be used as the charge transporting substance. Examples thereof include: electron-donating substances such as poly-N-vinylcarbazole and its derivatives, poly-γ-carbazolylethylglutamate and its derivatives, a pyrene-formaldehyde condensate and its derivatives, polyvinylpyrene, polyvinylphenanthrene, oxazole derivatives, oxodiazole derivatives, imidazole derivatives, 9-(p-diethylaminostyryl)anthracene, 1,1-bis(4-dibenzylaminophenyl) propane, styrylanthracene, styrylpyrazoline, phenylhydrazones, hydrazone derivatives, and azine compounds having a 3-methyl-2-benzothiazoline ring; electron-accepting substances such as fluorenone derivatives, dibenzothiophene derivatives, indenothiophene derivatives, phenanthrenequinone derivatives, indenopyridine derivatives, thioxantone derivatives, benzo[c]cinnoline derivatives, phenazine oxide derivatives, and tetracyanoethylene, tetracyanoquinodimethane, promanyl, chloranyl, benzoquinone; and the like.

The binder included in the charge transporting layer may be favorably a material having compatibility with charge transporting substances, and examples thereof include: polycarbonate, polyvinylbutyral, polyamide, polyester, polyketone, epoxy resins, polyurethane, polyvinylketone, polystyrene, polyacrylamide, phenol resins, phenoxy resins, polysulfone resins, and the like. It is desirable to use the binder having high volume resistance (preferably, $10^{13}$ Ωcm or more) and satisfactory filming property and electric potential characteristic. For example, the binder may include polystylene, polycarbonate, polyacrylate, and the like. Here, the binder may be used individually or as a mixture of two or more species. The inorganic photosensitive layer may be a layer containing one or more selected from a group of zinc oxide, selen, amorphous silicon, and the like. Between the conductive substrate and the photosensitive layer, a undercoat layer may be interposed. In addition, it may be possible to provide a protective layer, which is mainly used to protect the photosensitive layer, on a surface of the photosensitive layer. In the present embodiment, an aluminum pipe connected to the ground (GND) and a photoreceptor drum having a diameter of 30 mm and including an organic photosensitive layer, which has a thickness of 20 μm and is formed on a surface of the aluminum pipe are used. Moreover, in the present embodiment, the photoreceptor drum having an organic photosensitive layer is used as an image bearing member, as described above. However, the invention is not limited thereto. For example, dielectric may be used as the image bearing member so as to form an electrostatic latent image in an inflow method.

The electrostatic latent image forming section includes a charging roller 13*y* and an exposure section 14*y*. The charging roller 13*y* is a roller shaped member that is supported to be rotated around its axis by a driving mechanism (not shown), is provided to be pressed against and in contact with the surface of the photoreceptor drum 11*y*, and serves to charge the surface of the photoreceptor drum 11*y* so that the surface of the photoreceptor drum 11*y* has predetermined polarity and potential. In addition, as a charger for charging the photoreceptor drum 11*y*, a brush type charger, a charger type charger, or a saw tooth type charger may be used in addition to the charging roller 13*y*. The exposure section 14*y* irradiates a surface of the photoreceptor drum 11*y* that is charged with signal light corresponding to yellow image information, thereby forming an electrostatic latent image corresponding to the yellow image information on the surface of the photoreceptor drum 11*y*. For example, a semiconductor laser or the like may be used as the exposure section 14*y*. In the present embodiment, an electrostatic latent image having a latent image potential of −20 V is formed by charging the surface of the charging roller 13*y* to have an electric potential of −800 V by means of the charging roller 13*y*.

Referring to FIG. 3, the liquid-repellent particle supplying section 15*y* has the same configuration as a one-component developing device and includes a liquid-repellent particle tank 30*y*, a liquid-repellent particle supply roller 31*y*, a feed roller 32*y*, an agitating member 33*y*, and a regulating blade 34*y*.

The liquid-repellent particle tank 30*y* is a container shaped member having an internal space and has an opening 35*y* formed on a lateral side facing the photoreceptor drum 11*y*. The liquid-repellent particle tank 30*y* supports the liquid-repellent particle supply roller 31*y* at the opening 35*y* such that the liquid-repellent particle supply roller 31*y* is rotated, supports the feed roller 32*y* and the agitating member 33*y* in the internal space such that the feed roller 32*y* and the agitating member 33*y* are rotated, and stores liquid-repellent particles 7 which are particles having a liquid-repellent property, in the internal space. The liquid-repellent particles 7 are supplied from a liquid-repellent particle storage tank (not shown) to the liquid-repellent particle tank 30*y* in accordance with a situation in which the liquid-repellent particles 7 are consumed. In addition, the liquid-repellent particle tank 30*y* itself may be formed as a cartridge, such that the new liquid-repellent particle tank 30*y* can be provided at a point of time when the liquid-repellent particles 7 are all consumed. Here, the liquid-repellent particles 7 are made of a material having a liquid-repellent property of repelling a fixing fluid 8, and particles that can be negatively charged may be used as the liquid-repellent particles 7. Among the particles that can be negatively charged, fluorine resin particles are desirable. In the present embodiment, a polytetrafluorethylene particle (PTFE particle) having a particle size of 20 to 40 μm is used but is not limited thereto. For example, fluorine resin particles used for typical ink or paint may be used. Since the liquid-repellent particles 7 have a property of repelling the fixing fluid 8, the fixing fluid 8 does not almost stay on surfaces off the liquid-repellent particles 7 even though a small amount of fixing fluid 8 stays between the liquid-repellent particles 7 due to a surface tension or the like.

The liquid-repellent particle supply roller 31*y* is a roller member that is provided to be in contact with the photoreceptor drum 11*y*, carries a layer of the liquid-repellent particles 7 on a surface of the liquid-repellent particle supply roller 31*y*, and supplies the negatively-charged liquid-repellent particles 7 around an electrostatic latent image on the photoreceptor drum 11*y* in a part where the liquid-repellent particle supply roller 31*y* and the photoreceptor drum 11*y* are positioned to be closest to each other. When the liquid-repellent particles 7 are negatively charged, the liquid-repellent particles 7 are selectively adhered to a part (non-image part), in which an electrostatic latent image serving as an image part does not exist, in a predetermined region where an electrostatic latent image of the photoreceptor drum 11*y* is formed. For example, in the case of forming a document image, a text part is an image part where an electrostatic latent image exists and an empty part other than the text is a non-image part. As the liquid-repellent particle supply roller 31*y*, for example, it is possible to use a roller member having a core and a rubber layer formed on a surface of the core. An example of the core includes a core made of a metal material, such as an aluminum. The rubber layer is formed of a material obtained by adding a conducting agent, such as carbon black or ion, in rubbers, such as urethane rubber, silicone rubber, or ethylenepropylene rubber (EPDM). The rubber layer may be a foamed rubber. A power supply (not shown) that applies a negative voltage to a corresponding roller is connected to the liquid-repellent particle supply roller 31*y*. When the negative voltage is applied, the liquid-repellent particles 7 on the liquid-repellent particle supply roller 31*y* are adhered on the non-image part. In the present embodiment, a voltage of −300 V is applied. Moreover, in the present embodiment, the liquid-repellent particle supply roller 31*y* is disposed to be in contact with the photoreceptor drum 11*y* but is not limited thereto. For example, the liquid-repellent particle supply roller 31*y* may be disposed such that the liquid-repellent particle supply roller 31*y* is spaced apart from the photoreceptor drum 11*y* with a gap therebetween.

The feed roller 32*y* is a roller member that is provided to be pressed against and in contact with the liquid-repellent particle supply roller 31*y* and serves to supply the liquid-repellent particles 7 on the surface of the liquid-repellent particle supply roller 31*y*. As the feed roller 32*y*, it is possible to use a roller member formed of the same material as the liquid-repellent particle supply roller 31*y*. The agitating member 33*y* serves to agitate the liquid-repellent particles 7 inside the liquid-repellent particle tank 30*y* and supply the liquid-repellent particles 7 around the feed roller 32*y*. For example, a mixing paddle or the like may be used as the agitating member 33*y*. The regulating blade 34*y* is a plate shaped member provided such that an end of the regulating blade 34*y* is supported against the liquid-repellent particle tank 30*y* and the other end thereof is in contact with the surface of the liquid-repellent particle supply roller 31*y*. The regulating blade 34*y* serves to regulate the layer thickness of a liquid-repellent particle layer located on the surface of the liquid-repellent particle supply roller 31*y* and to negatively charge the liquid-repellent particles 7 by means of friction between the regulating blade 34*y* and the liquid-repellent particles 7. For example, a plate shaped member made of a metal material, such as a stainless steel, may be used as the regulating blade 34*y*.

According to the liquid-repellent particle supplying section 15*y*, the liquid-repellent particles 7 inside the liquid-repellent particle tank 30*y* are supplied onto the surface of the liquid-repellent particle supply roller 31*y* by means of rotational driving of the agitating member 33*y* and the feed roller 32*y* so as to form a layer, the thickness of the layer becomes uniform and negatively charged by the friction between the liquid-repellent particles 7 and the regulating blade 34*y*, and the liquid-repellent particles 7 are supplied to a non-image part, excluding an electrostatic latent image, on the photoreceptor drum 11*y* to be then adhered onto the non-image part.

Referring to FIG. 4, the fixing fluid supplying section 16*y* is a roller member that supplies the fixing fluid 8 to a part (image part) of an electrostatic latent image on the photoreceptor drum 11*y*. As the fixing fluid supplying section 16*y*, for example, a roller member having a core 36*y*, a permeation control layer 37*y* formed on a surface of the core 36*y*, and a porous tube 38*y* formed on a surface of the permeation control layer 37*y* is used. As the core 36*y*, a core made of a metal, such as aluminum, may be used. The core 36*y* contains the fixing fluid 8 in an internal space thereof. The core 36*y* has a plurality of through holes (not shown) used to supply the fixing fluid 8 to the permeation control layer 37*y*. The permeation control layer 37*y* is provided to prevent the fixing fluid 8 from being excessively supplied to the porous layer 38*y*. In addition, the permeation control layer 37*y* is formed of a material that allows the fixing fluid 8 to permeate therethrough and be held therein and can be elastically deformed. For example, felt or open cell foam (sponge) of a rubber is used as the permeation control layer 37*y*. The porous layer 38*y* serves to apply the fixing fluid 8 supplied from the, permeation control layer 37*y* to an electrostatic latent image part on the photoreceptor drum 11*y*. In this case, the fixing fluid 8 may be adhered onto the liquid-repellent particles 7 around the electrostatic latent image. However, the fixing fluid 8 does not almost stay on surfaces of the liquid-repellent particles 7 even though the fixing fluid 8 may permeate between the liquid-repellent particles 7 due to the surface tension therebetween. Thus, in appearance, the fixing fluid 8 is selectively supplied to the part of the electrostatic latent image. The porous layer 38*y* is formed of a material that can be elastically deformed and be made porous. Specific examples of the material include polytetrafluorethylene (PTFE), polyurethane, polyimide, and the like. Material, hole diameter, hole rate, and the like of the porous layer 38*y* may be appropriately selected according to composition of the fixing fluid 8. In the present embodiment, a roller member obtained by sequentially providing the permeation control layer 37*y* made of felt and the porous layer 38*y* made of porous PTFE on a surface of the core 36*y* made of aluminum is used as the fixing fluid supplying section 16*y*.

Any kind of known materials may be used as the fixing fluid 8 without limitation as long as the materials are liquid materials that allow toner 9 to be fixed on the recording medium 6. Among the known materials, a material suitable for filming the toner 9 is preferable. It is more preferable to use a material that is suitable for the filming, is easily dried, and allows power of adhesion of the toner 9 to the recording medium 6 to increase by drying. More specifically, a preferable liquid material that allows the fixing fluid 8 and the toner 9 to be softened and/or swollen is composition containing water and organic compound capable of softening and/or swelling the toner 9. The organic compound is not particularly limited as long as the material acts to soften and/or swell the toner and can be dispersed or dissolved in water. For example, higher glycol ethers, ethylene glycol monoether, diethylene glycol monoether, ethylene glycol monomethyl ether, 2-methoxyethanol, diethylene glycol, diethylene glycol monoethyl ether, propylene glycol monomethyl ether, butylcellosolve ethylcarbitol, aliphatic dibasic acid esters and unsaturated dibasic esters (for example, DBE, maleic acid esters, itaconic acid esters), polybasic esters (for example, trimellitic acid esters), ester-based high boiling temperature mixed solvents, and the like may be mentioned. These compounds may be used individually or as a mixture of two or more species. The content of these organic compounds can be appropriately selected from a wide range in accordance with the type of the organic compound itself, the composition of the toner 9, or the like, but a preferable content thereof is 10 to 30% by weight of the total amount of the fixing fluid 8.

The fixing fluid 8 may contain surfactants. Specific examples of the surfactant include anionic surfactants, such as fatty acid derivative-sulfuric acid esters, sulfonic acid-type anionic surfactants, and phosphoric acid esters; cationic surfactants, such as quaternary ammonium salts, heterocyclic amine, and amine compounds; amphoterionic surfactants such as amino acid esters, amino acids, and sulfobetaine; nonionic surfactants; polyoxyalkylene alkyl ether; polyoxyethylenealkylamine. The surfactants may be used individually or as a mixture of two or more species. The content of the surfactants can be appropriately selected from a wide range in accordance with various conditions such as the type and content of the organic compounds that are used in combination, toner component, type of the surfactant, and the like, but a preferable content thereof is 1 to 10% by weight of the total amount of the fixing fluid 8. Specific examples of the fixing fluid 8 include a composition containing 10 to 30% by weight of the organic compound, with the balance being water; a composition containing 10 to 30% by weight of the organic compound, and 1 to 10% by weight of a surfactant, with the balance being water; and the like. In the present embodiment, a fixing fluid 8 containing 20% by weight of a higher glycol ether (organic compound) and 5% by weight of a sulfonic acid-type surfactant (surfactant), with the balance being water, is used.

Referring to FIG. 5, the image forming roller 17*y* is a roller member that is provided to be in contact with the photoreceptor drum 11*y*, is supported to be rotated around its axis by a driving mechanism (not shown), and serves to selectively apply only the fixing fluid 8 supplied from the photoreceptor drum 11*y*. As the image forming roller 17*y*, for example, a roller member having a core 40*y*, an elastic layer 41*y* provided on a surface of the core 40*y*, and a surface layer 42*y* provided on a surface of the elastic layer 41*y* is used. As the core 40*y*, a core made of a metal, such as aluminum, may be used. The elastic layer 41*y* is mainly provided to cause the surface of the image forming roller 17*y* to follow the conveying of the recording medium 6 and is formed of rubbers, such as a silicone rubber. As will be described later, the toner 9 that is softened and swollen is adhered on the surface layer 42*y*. Accordingly, in order to transfer the toner 9 onto the recording medium 6, a material that allows the toner 9 that is softened and swollen to easily strip is used for the surface layer 42*y*. Examples of the material include fluorine resins, such as polytetrafluorethylene (PTFE), perfluoroalkoxy resin (PFA), fluorinated ethylene propylene resin (FEP), polyvinylidene fluoride (PVDF), and ethylene-tetrafluorethylene copolymer (ETFE). In the present embodiment, a roller member obtained by sequentially forming a silicone rubber layer with a thickness of 2 mm and a PFA layer with a thickness of 30 μm on a surface of a core with a thickness of 3 mm made of aluminum is used as the image forming roller 17*y*.

A power supply (not shown) that applies a negative voltage to the image forming roller 17*y* is connected to the image forming roller 17*y*. By appropriately a negative voltage to the image forming roller 17*y*, it is prevented that the liquid-repellent particles 7 adhered onto the photoreceptor drum 11*y* due to an electrostatic force move to the surface of the image forming roller 17*y* such that only the fixing fluid 8 is selectively adhered onto the surface of the image forming roller 17*y*. In addition, the adhesion of the fixing fluid 8 to the image forming roller 17*y* is smoothly performed by considering a contact angle of the fixing fluid 8 with respect to respective members. For example, in a representative example of the image forming apparatus 1 in which polycarbonate is used as a binding resin of an organic photosensitive layer of the photoreceptor drum 11*y* and the surface layer 42*y* of the image forming roller 17*y* is made of PFA, a contact angle of the fixing fluid 8 with respect to the surface of the photoreceptor drum 11*y* is 50° and a contact angle of the fixing fluid 8 with respect to the surface of the image forming roller 17*y* is 70°. The application of the negative voltage is sufficiently effective by keeping a difference between the contact angles in this order, and accordingly, liquid droplets of the fixing fluid 8 are adhered on the surface of the image forming roller 17*y*. Each one of the liquid droplets becomes a circular dot having smooth outline due to the surface tension, and all of the liquid droplets form a fixing fluid image. In the present embodiment, a negative voltage of −800 V is applied to the image forming roller 17*y*.

Further, a heating section 19*y* serving as a drying section is provided inside the image forming roller 17*y*. The heating section 19*y* serves to heat the image forming roller 17*y*. In addition, when the toner 9 is supplied to the fixing fluid 8 adhered on the surface of the image forming roller 17*y* in a subsequent process, the heating section 19*y* volatilizes or dries a part of the fixing fluid 8 after the toner 9 is swollen and softened, thereby improving the viscosity of the toner 9. Accordingly, the adhesive power of the toner image, which is formed on the image forming roller 17*y*, with respect to the recording medium 6 increases. As a result, it is possible to obtain an image having a high fixing strength with respect to the recording medium 6. Preferably, the image forming roller 17*y* or the toner 9 on the image forming roller 17*y* is heated to be equal to or larger than the glass transition temperature of the toner 9.

The heating temperature of the image forming roller 17*y* is controlled by disposing a temperature sensor (not shown) around the surface of the image forming roller 17*y*, for example. That is, a detection result of the temperature of a surface of the image forming roller 17*y* performed by the temperature sensor is transmitted to the control unit 5 that controls the entire operation of the image forming apparatus 1 and is then inputted to a recording section of the control unit 5. A calculation section of the control unit 5 extracts and compares set heating temperature, which is inputted beforehand in a storage section, with the detection result. A control section of the control unit 5 transmits a control signal to a power supply (not shown) that supplies power to the heating section 19*y* on the basis of a determination result of the calculation section that the detection result is lower than the set heating temperature, such that the heating section 19*y* starts heating. Furthermore, on the basis of the determination result of the calculation section that the detection result is equal to the set heating temperature, the control section transmits a control signal for stopping heating of the heating section 19*y* to the power supply in the case when the control section causes the heating section 19*y* to heat and holds transmitting the control signal in the case when the control section does not cause the heating section 19*y* to heat. Thus, the surface temperature of the image forming roller 17*y* is maintained around the set temperature.

As the heating section 19*y*, a halogen lamp or the like is used. In the present embodiment, the surface temperature of the image forming roller 17*y* is set to 80° C. In addition, in the case when the toner 9 is adhered onto a part of the surface of the image forming roller 17*y* where a dot of the fixing fluid 8 does not exist and is then transferred onto the recording medium 6, blur occurs, which deteriorates the quality of a formed image. In order to prevent the image from deteriorating, the surface of the image forming roller 17*y* may be heated to be equal to or larger than a glass transition temperature Tg of the toner 9. In contrast, the toner 9 to which the fixing fluid 8 is not applied shows larger adhesive power with respect to the image forming roller 17*y* than the recording medium 6. Accordingly, since the toner 9 to which the fixing fluid 8 is not applied is not transferred onto the recording medium 6, the blur is prevented. The toner 9 adhered on the image forming roller 17*y* may be removed by using a cleaning section 61, for example, which will be described later.

Referring to FIG. 6, the developing section 18*y* serves to supply the toner 9 to dots of the fixing fluid 8 on the image forming roller 17*y* and develop an image of the fixing fluid 8 as a toner image. The developing section 18*y* is a one-component developing device and includes a developing tank 43*y*, a developing roller 44*y*, a feed roller 45*y*, an agitating member 46*y*, and a regulating blade 47*y*. The developing tank 43*y* is a container shaped member having an internal space and has an opening 48*y* formed on a lateral side facing the image forming roller 17*y*. The developing tank 43*y* supports the developing roller 44*y* so as to be rotated in the opening 48*y*, supports the feed roller 45*y* and the agitating member 46*y* so as to be rotated in the internal space, and contains the toner 9 in the internal space. The toner 9 is supplied from a toner cartridge (not shown) to the developing tank 43*y* in accordance with a situation in which the toner 9 is consumed. The developing roller 44*y* is a roller member that is provided to be spaced apart from the photoreceptor drum 11*y* with a gap therebetween, bears a toner layer on a surface thereof, and supplies the toner 9 to the dots of the fixing fluid 8 on the image forming roller 17*y* in a part where the developing roller 44*y* and the image forming roller 17*y* are positioned to be closest to each other. A power supply (not shown) that applies a negative voltage to a corresponding roller is connected to the developing roller 44*y*. When the negative voltage is applied, the toner 9 on the developing roller 44*y* is adhered on the dots of the fixing fluid 8.

The feed roller 45*y* is a roller member that is provided to be pressed against and in contact with the developing roller 44*y* and serves to supply the toner 9 on the surface of the developing roller 44*y*. The agitating member 46*y* serves to agitate the toner 9 inside the developing tank 43*y* and supply the toner 9 around the feed roller 45*y*. For example, a mixing paddle or the like may be used as the agitating member 46*y*. The regulating blade 47*y* is a plate shaped member provided such that an end of the regulating blade 47*y* is supported against the developing tank 43*y* and the other end thereof is in contact with the surface of the developing roller 44*y*. The regulating blade 47*y* serves to regulate the layer thickness of a toner layer located on the surface of the developing roller 44*y* and to negatively charge the toner 9 by means of friction between the regulating blade 47*y* and the toner 9. For example, a plate shaped member made of a metal material, such as a stainless steel, may be used as the regulating blade 47*y*. According to the developing section 18*y*, the toner 9 inside the developing tank 43*y* is supplied onto the surface of the developing roller 44*y* by means of rotational driving of the agitating member 46*y* and the feed roller 45*y* so as to form a layer, the thickness of the layer becomes uniform and negatively charged by the friction between the toner 9 and the regulating blade 47*y*, and the toner 9 is adhered onto the dots of the fixing fluid 8 on the image forming roller 17*y* so as to develop the fixing fluid image.

In the present embodiment, it is set such that the gap between the image forming roller 17*y* and the developing roller 44*y* is 0.2 mm, a negative voltage applied to the image forming roller 17*y* is −800 V, and a negative voltage applied to the developing roller 44*y* is −400 V. In the setting, when a sine wave of 1000 Vp-p is applied to the gap between the image forming roller 17*y* and the developing roller 44*y*, the non-contact phenomenon does not further proceed. Accordingly, the toner 9 reciprocates between the image forming roller 17*y* and the developing roller 44*y*. However, the toner 9 being in contact with the fixing fluid 8 on the surface of the image forming roller 17*y* cannot return to the developing roller 44*y* since the adhesion of the toner 9, which is in contact with the fixing fluid 8 on the surface of the image forming roller 17*y*, with respect to the fixing fluid 8 is larger than a force returning to the developing roller 44*y*. On the other hand, since the toner 9 being in contact with a part of the image forming roller 17*y* where the fixing fluid 8 is not adhered reciprocates, the toner 9 being in contact with a part of the image forming roller 17*y* where the fixing fluid 8 is not adhered is not adhered onto the image forming roller 17*y*. Thus, the toner 9 may be selectively supplied to only a region where the fixing fluid 8 is adhered, with bias setting that causes the non-contact phenomenon not to further proceed. Surfaces of the toner 9 adhered onto the fixing fluid 8 have viscosity due to a toner softening and swelling action of the fixing fluid 8, which makes the toner 9 to be adhered to each other. At this time, in the case when the amount of the fixing fluid 8 is large, the viscosity does not easily occur, such that the toner image may not be sufficiently transferred onto the recording medium 6. In addition, in the case when the amount of the fixing fluid 8 is small, the action of swelling and softening the toner 9 is weak, such that the viscosity may not occur sufficiently. Therefore, preferably, when the fixing fluid 8 is in contact with the toner 9 in the gap between the image forming roller 17*y* and the developing roller 44*y*, the amount of the fixing fluid 8 is sufficient (preferably, 0.1 to 1 times of weight of the toner 9). In addition, when the toner image is transferred onto the recording medium 6, the fixing fluid 8 needs to be appropriately volatilized or dried. Further, it is preferable to improve the viscosity of the toner 9 by volatilizing or drying the fixing fluid 8. For this reason, as described above, there is adopted the configuration in which the image forming roller 17*y* is heated by the heating section 19*y* so as to volatilize the fixing fluid 8. Since the heating temperature is typically maintained constant, the amount of the fixing fluid 8 that is volatilized is correlated with drying time. The drying time herein refers to a period of time until the toner 9 is transferred onto the recording medium 6 after the toner 9 is in contact with the fixing fluid 8. Accordingly, the drying time is determined by a process speed. In the present embodiment, the process speed is set to 200 mm/s and the heating temperature is set to 80° C. or more, such that the toner image on the image forming roller 17*y* can be smoothly transferred onto the recording medium 6.

The toner used herein contains a binding resin, a coloring agent, and a release agent as needed. The binding resin is not particularly limited as long as the material can be fixed onto the recording medium 6 by the use of the fixing fluid 8. Example thereof include: polystyrene, homopolymers of styrene substituent, styrene-based copolymers, polyvinyl chloride, polyvinyl acetate, polyethylene, polypropylene, polyester, polyurethane, and the like. The binding resin may be used individually or as a mixture of two or more species. Among the binding resins described above, a resin having a softening temperature of 100 to 150° C. and a glass transition temperature of 50 to 80° C. is preferable in consideration of preservation of toner itself, durability, control of softening and/or swelling toner by supplying the fixing fluid, and the like, and polyester is particularly preferable. The polyester is easily swollen and/or softened by an organic solvent that is easily available and cheap, so as to become transmissive. Thus, a satisfactory color can be obtained by using a subtractive color mixing technique in a state in which a color toner image obtained by overlaying toner images corresponding to different single colors to one another is fixed on a recording medium. Moreover, in the case of using a resin having a softening temperature (or molecular weight) higher than a resin belonging to the softening temperature range described above, it is prevented that the toner deteriorates due to the load at the time of development. As a result, it is possible to obtain a developed toner image that is stable over a long period of time, further, to obtain an image that is stable at a high level.

As the coloring agent, pigments and dyes for toner, which have been used in known electrophotographic image forming techniques, may be used. However, in order to prevent the blur due to the fixing fluid, a pigment that is not dissolved in the fixing fluid is preferable but dyes, such as nigrosine dyes, are not preferable. Specific examples of the pigment include: organic pigments such as azo-based pigments, benzimidazolone-based pigments, quinacridone-based pigments, phthalocyanine-based pigments, isoindolinone-based pigments, isoindoline-based pigments, dioxazine-based pigments, anthraquinone-based pigments, perylene-based pigments, perinone-based pigments, thio-indigo-based pigments, quinophthalone-based pigments, and metal complex-based pigments; inorganic pigments such as carbon black, titanium oxide, molybdenum red pigments, chrome yellow pigments, titanium yellow pigments, chromium oxide, and Berlin Blue; and metal powders such as aluminum powder. The release agent is not particularly limited as long as the material softens and/or swells under the action of the fixing fluid 8, and examples thereof include waxes such as polyethylene wax, polypropylene wax, paraffin wax, and the like. Among the waxes described above, it is preferable to use a wax having glass transition temperature lower than a binding resin that is used. Since the wax having glass transition temperature lower than the binding resin is easily softened by heating, binding power between the toner 9 and adhesive power of the toner 9 with respect to the image forming roller 17*y* or the recording medium 6 increase at the temperature lower than the glass transition temperature of the toner 9 itself. Accordingly, it is possible to decrease flow, condensation, and the like of the toner 9 when the wax is applied to the fixing fluid 8. Further, due to softening of wax, the fixing fluid 8 permeates inside toner particles from parts of the toner particles where the wax exists. Accordingly, after the wax is applied to the fixing fluid 8, the entire toner 9 softens and/or swells in a short period of time. As a result, when the toner 9 is transferred and fixed on the recording medium 6, it is possible to obtain the sufficient fixing strength and to obtain a satisfactory color due to overlaying of toner images.

The toner 9 may contain one or more kinds of typical additives for toner, such as a charge controlling agent, a flowability enhancer, a fixation accelerator, or a conducting agent as necessary. The average volume particle size of the toner 9 is not particularly limited. Preferably, the average volume particle size of the toner 9 is 0.5 to 7 μm. In the case of using the toner 9 belonging to the particle size range, the surface area of the toner 9 per weight becomes large and an area of the toner 9 being in contact with the fixing fluid 8 increases, such that the toner 9 is easily fixed. Thus, it is possible to reduce the amount of the fixing fluid 8 that is used and to fix the toner image onto the recording medium 6 and then dry the toner image within a short period of time. Moreover, in the case when the average volume particle size of toner is small, a coat rate of toner with respect to the recording medium 6 increases. As a result, it is possible to obtain a high-quality image with a small amount of toner and to reduce the amount of toner consumption. Furthermore, it is also possible to reduce the amount of fixing fluid consumption.

The liquid-repellent particle recovering section 20*y* is used to remove the liquid-repellent particles 7 on the photoreceptor drum 11*y* and clean the surface of the photoreceptor drum 11*y* after the fixing fluid 8 on the photoreceptor drum 11*y* is transferred onto the image forming roller 17*y*. In addition, the liquid-repellent particle recovering section 20*y* is provided to be detached from the photoreceptor drum 11*y* or be in contact with the photoreceptor drum 11*y* by means of a driving mechanism (not shown). The liquid-repellent particle recovering section 20*y* includes a cleaning blade (not shown) and a liquid-repellent particle recovering tank (not shown), for example. The cleaning blade is a plate shaped member that has one end being in contact with the surface of the photoreceptor drum 11*y* and the other end supported against the liquid-repellent particle recovering tank and is used to scrape off the liquid-repellent particles 7 on the surface of the photoreceptor drum 11*y*. A material such as a urethane rubber, which does not damage the surface of the photoreceptor drum 11*y* and has an appropriate mechanical strength, is used for the cleaning blade. The liquid-repellent particle recovering tank is a container shaped member having an internal space and temporarily stores the liquid-repellent particles 7 scraped by the cleaning blade in the internal space. The detachment and contact of the liquid-repellent particle recovering section 20*y* with respect to the photoreceptor drum 11*y* is controlled by the control unit 5. That is, since it is not necessary to recover the liquid-repellent particles 7 in the case when the same image as a previous image is formed, the liquid-repellent particle recovering section 20*y* is spaced apart from the photoreceptor drum 11*y*. In contrast, since it is necessary to recover the liquid-repellent particles 7 in the case when an image different from the previous image is formed, the liquid-repellent particle recovering section 20*y* is in contact with the photoreceptor drum 11*y*. The control unit 5 extracts previous image information and next image information inputted to the storage section and causes the calculation section to make a determination. In the case when it is determined that the images are equal, the control unit 5 transmits a control signal from the control section to the driving mechanism of the liquid-repellent particle recovering section 20*y* such that the liquid-repellent particle recovering section 20*y* is spaced apart from the photoreceptor drum 11*y*. On the other hand, in the case when it is determined that the images are different from each other, the control unit 5 transmits a control signal such that the liquid-repellent particle recovering section 20*y* is in contact with the photoreceptor drum 11*y*. With the configuration described above, for example, in the case of forming a plurality of equal images, it is possible to form an image only by supplying the fixing fluid 8 without recovering the liquid-repellent particles 7, which is effective. In addition, the image forming speed can also be increased.

According to the image forming unit 10*y*, the liquid-repellent particles 7 are supplied to a part on the photoreceptor drum 11*y* excluding an electrostatic latent image, the fixing fluid 8 is supplied to a part of the electrostatic latent image, only the fixing fluid 8 is selectively transferred onto the surface of the image forming roller 17*y* so as to form a fixing fluid image, the fixing fluid image is developed as a toner image by supplying the toner 9 on the fixing fluid image, the toner is softened and/or swollen so as to be fixable, and then the softened and/or swollen toner is transferred onto the recording medium 6 to thereby form an image. Since the image forming units 10*m*, 10*c*, and 10*b* have structures similar to the image forming unit 10*y* except that the image forming units 10*m*, 10*c*, and 10*b* use magenta toner, cyan toner, and black toner, respectively. Therefore, the image forming units 10*m*, 10*c*, and 10*b* have the same reference numerals and are suffixed with 'm' indicating magenta, 'c' indicating cyan, and 'b' indicating black, respectively, and an explanation thereof will be omitted.

Referring to FIG. 1, the transfer section 3 includes a conveying belt 21, transfer rollers 22*b*, 22*c*, 22*m*, and 22*y*, a driving roller 23, and a driven roller 24. The conveying belt 21 is an endless-belt-shaped recording medium conveying section that is stretched over between the driving roller 23 and the driven roller 24 so as to form a loop shaped movement path. In addition, the conveying belt 21 rotates in the direction indicated by the arrow 25 and in substantially the same circumferential speed as the image forming rollers 17*b*, 17*c*, 17*m*, and 17*y*. The transfer rollers 22*b*, 22*c*, 22*m*, and 22*y* are roller members that are pressed against and in contact with the image forming rollers 17*b*, 17*c*, 17*m*, and 17*y* with the conveying belt 21 interposed therebetween so as to form four transfer nip parts and are supported to be rotated around axes thereof by a driving mechanism (not shown), respectively. In order to reliably transfer toner images, which are formed on surfaces of the image forming rollers 17*b*, 17*c*, 17*m*, and 17*y*, onto the recording medium 6, a transfer bias having a polarity opposite to a charging polarity of toner may be applied to the transfer rollers 22*b*, 22*c*, 22*m*, and 22*y* under the electrostatic voltage control, as necessary.

The driving roller 23 is supported to be rotated around its axis by a driving mechanism (not shown) and causes the conveying belt 21 to be rotated in the direction indicated by the arrow 25. The driven roller 24 is supported to be rotated when the driving roller 23 rotates and has a function as a tension roller that helps the rotary driving of the conveying belt 21 and applies appropriate tension to the conveying belt 21. In the present embodiment, the rotary driving speed of the conveying belt 21, that is, the recording medium conveying speed is 200 mm/s, the contact pressing force of the transfer rollers 22*b*, 22*c*, 22*m*, and 22*y* with respect to the image forming rollers 17*b*, 17*c*, 17*m*, and 17*y* in the transfer nip parts is 200 N, the nip length of each of the transfer nip parts is 4 mm, the length of the image forming rollers 17*b*, 17*c*, 17*m*, and 17*y* being in contact with the recording medium 6 is 320 mm, and the maximum width of a corresponding recording medium is A3 vertical size. According to the transfer section 3, when the recording medium 6 supplied from the recording medium supplying section 4 (which will be described later) is placed on the conveying belt 21 to pass through the transfer nip parts, the toner images corresponding to black, cyan, magenta, and yellow on the image forming rollers 17*b*, 17*c*, 17*m*, and 17*y* are sequentially transferred and overlaid. As a result, a multi colored image 9*a* is formed on the recording medium 6 to be ejected to the outside of the image forming apparatus 1.

The recording medium supplying section 4 includes a recording medium cassette 26, a pickup roller 27, and a pair of registration rollers 28. The recording medium cassette 26 stores the recording medium 6. The pickup roller 27 serves to feed the recording medium 6 on a conveying path one by one. The registration rollers 28 feed the recording medium 6 onto the conveying belt 21 in synchronization with forming of the toner images on the image forming rollers 17*b*, 17*c*, 17*m*, and 17*y* and conveying of the toner images into the transfer nip parts. According to the recording medium supplying section 4, the recording medium 6 stored in the recording medium cassette 26 is fed onto the conveying path one by one by means of the pickup roller 27 and is also fed onto the conveying belt 21 by means of the registration rollers 28.

The control unit 5 is provided at an upper part inside the internal space of the image forming apparatus 1. In addition, the control unit 5 includes a processing circuit which includes the control section, the calculation section, the storage section and is realized by, for example, a microcomputer containing a central processing unit (CPU). The storage section of the control unit 5 is inputted with an image forming command, which is transmitted through an operation panel (not shown) disposed at an upper surface of the image forming apparatus 1, and detection results of sensors (not shown) disposed at various places inside the image forming apparatus 1, image information from external equipment, and the like. In the calculation section, various determination are made on the basis of the various kinds of data input (image forming command, detection results, image information, and the like). A control signal is transmitted from the control section according to the detection result of the calculation section, such that the entire operation of the image forming apparatus 1 is controlled. As for the storage section, one that is commercially available in this field may be used. For example, a read only memory (ROM), a random access memory (RAM), a hard disk drive (HDD), and the like may be mentioned. As the external equipment, it is possible to use electronic and electrical equipment that can form or acquire image information and can be electrically connected to an image forming apparatus. For example, a computer, a digital camera, a television, a video recorder, a DVD recorder, a facsimile, and the like may be mentioned. The control unit 5 includes a power supply as well as the processing circuit described above. The power supply supplies power to each device within the image forming apparatus 1 as well as the control unit 5.

According to the image forming apparatus 1, the liquid-repellent particles 7 are supplied around the electrostatic latent image on the photoreceptor drums 11*b*, 11*c*, 11*m*, and 11*y*, only the part of the electrostatic latent image is selectively converted into a fixing fluid image by applying the fixing fluid 8 to the electrostatic latent image, the fixing fluid image is developed by selectively supplying the toner 9 onto the fixing fluid image, and the developed image is transferred onto the recording medium 6, thereby forming an image.

Figure 7:
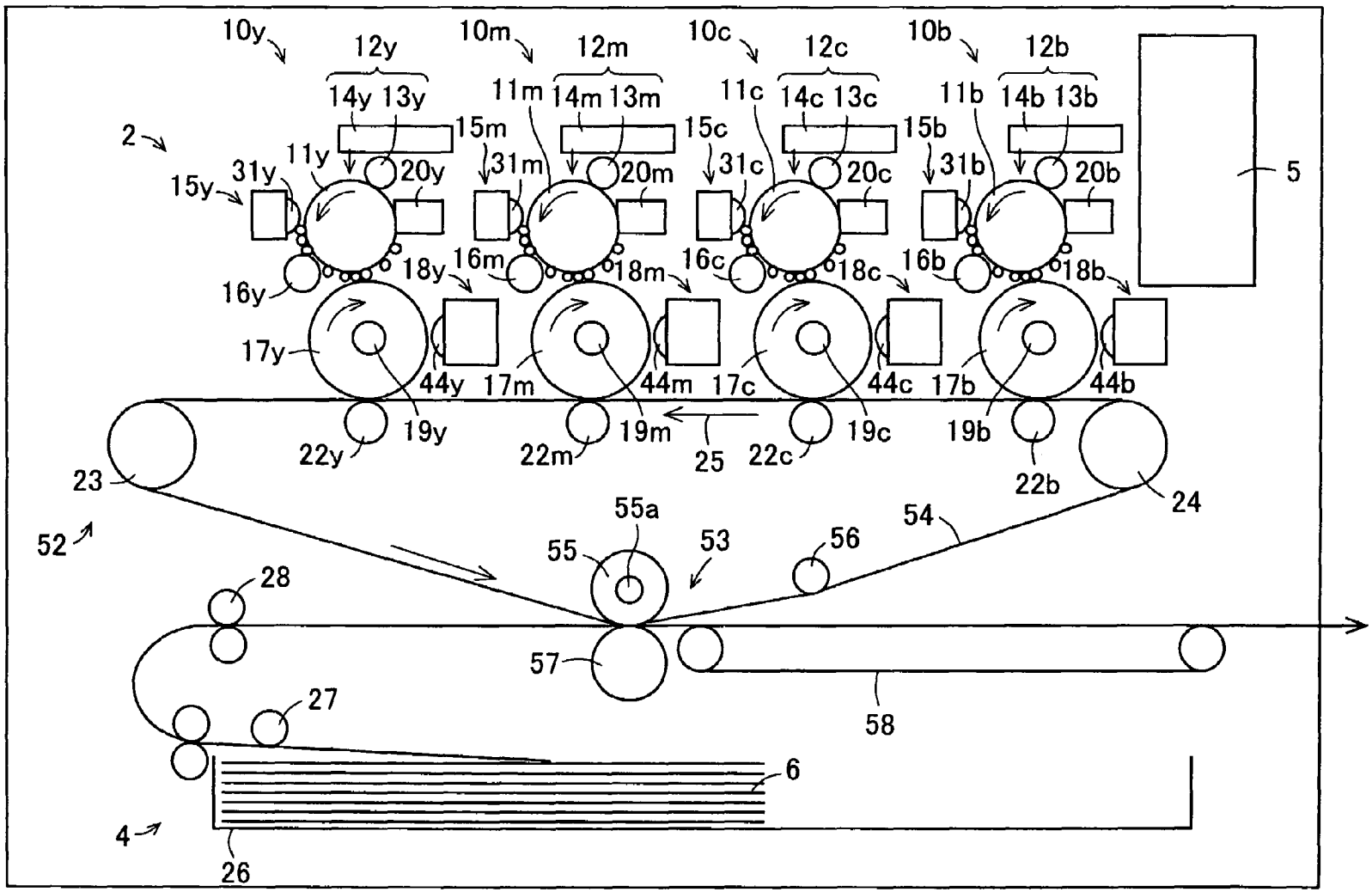
FIG. 7 is a cross-sectional view schematically illustrating the configuration of an image forming apparatus according to a second embodiment of the invention.

FIG. 7 is a cross-sectional view schematically illustrating the configuration of an image forming apparatus 51 according to a second embodiment of the invention. The image forming apparatus 51 is similar to the image forming apparatus 1. Accordingly, corresponding parts are denoted by the same reference numerals, and an explanation thereof will be omitted. The image forming apparatus 51 is characterized in that intermediate a transfer section 52, a transferring and fixing section 53, and a discharging section 58 are included instead of the transfer section 3 in the image forming apparatus 1.

The intermediate transfer section 52 includes an intermediate transfer belt 54, transfer rollers 22*b*, 22*c*, 22*m*, and 22*y*, a driving roller 23, a driven roller 24, a heating roller 55, and a tension roller 56. The intermediate transfer belt 54 is an endless-belt-shaped toner image bearing section that is stretched over the driving roller 23, the driven roller 24, the heating roller 55, and the tension roller 56 so as to form a loop shaped movement path. In addition, the intermediate transfer belt 54 rotates in the direction indicated by the arrow 25 and in substantially the same circumferential speed as the photoreceptor drum 11*y*, 11*m*, 11*c*, and 11*b*. The intermediate transfer belt 54 is not particularly limited as long as the material is configured such that the fixing fluid 8 does not permeate thereinto. For example, a member obtained by stacking a film shaped base material, an elastic resin layer formed on a surface of the film shaped base material, and a fluorine resin containing coating layer formed on a surface of the elastic resin layer; and a member obtained by stacking a film shaped base material and a fluorine resin containing coating layer formed on a surface of the film shaped base material may be mentioned.

The transfer rollers 22*b*, 22*c*, 22*m*, and 22*y* are pressed against and in contact with the image forming rollers 17*b*, 17*c*, 17*m*, and 17*y* with the intermediate transfer belt 54 interposed therebetween so as to form transfer nip parts, respectively. The heating roller 55 is a roller member that is supported to be rotated by the rotation around its axis using a driving mechanism (not shown), has a heating section 55*a* therein, heats toner images, which are under softened and swollen states, borne on the intermediate transfer belt 54 and conveyed to the transferring and fixing nip parts (which will be described later), and helps the toner images transferred and fixed onto the recording medium 6. In addition, the heating roller 55 is also used as a transferring and fixing section. For example, a halogen lamp or the like may be used as the heating section 55*a*. The tension roller 56 is a roller member that applies appropriate tension to the intermediate transfer belt 54 together with the driven roller 24. According to the intermediate transfer section 52, the toner images, which are applied onto the fixing fluid image by the image forming rollers 17*b*, 17*c*, 17*m*, and 17*y* and are under the swollen and softened state, are transferred and overlaid one another at predetermined positions of the intermediate transfer belt 54 in the transfer nip parts. Then, the multi colored toner image is conveyed to the transferring and fixing nip parts (which will be described later) by the rotation of the intermediate transfer belt 54.

The transferring and fixing section 53 includes the heating roller 55 and a transferring and fixing roller 57. The transferring and fixing roller 57 is a roller member that is supported to be rotated around its axis by a driving mechanism (not shown) and is pressed against and in contact with the heating roller 55 with the intermediate transfer belt 54 interposed therebetween. A part where the heating roller 55 is pressed against and in contact with the transferring and fixing roller 57 is a transferring and fixing nip part. In the present embodiment, the temperature at which the heating roller 55 heats the intermediate transfer belt 54 and the toner image on the intermediate transfer belt 54 is set to 80° C. According to the transferring and fixing section 53, the toner images, which are under softened and swollen states, borne on the intermediate transfer belt 54 and conveyed and the recording medium 6, which is fed from the recording medium supplying section 4 in synchronization with the conveying of the toner images, are overlaid each other in the transferring and fixing nip parts and are then heated and pressed. Then, the toner images are transferred onto the recording medium 6 to form an image.

According to the image forming apparatus 51, the toner images, which are under softened and swollen states, formed by the toner image forming section 2 are transferred and fixed onto the recording medium 6 through the intermediate transfer section 52 and the transferring and fixing section 53, and thus an image is formed on the recording medium 6. The recording medium 6 on which an image is formed is discharged to the outside of the image forming apparatus 51 by the discharging section 58.

Figure 8:
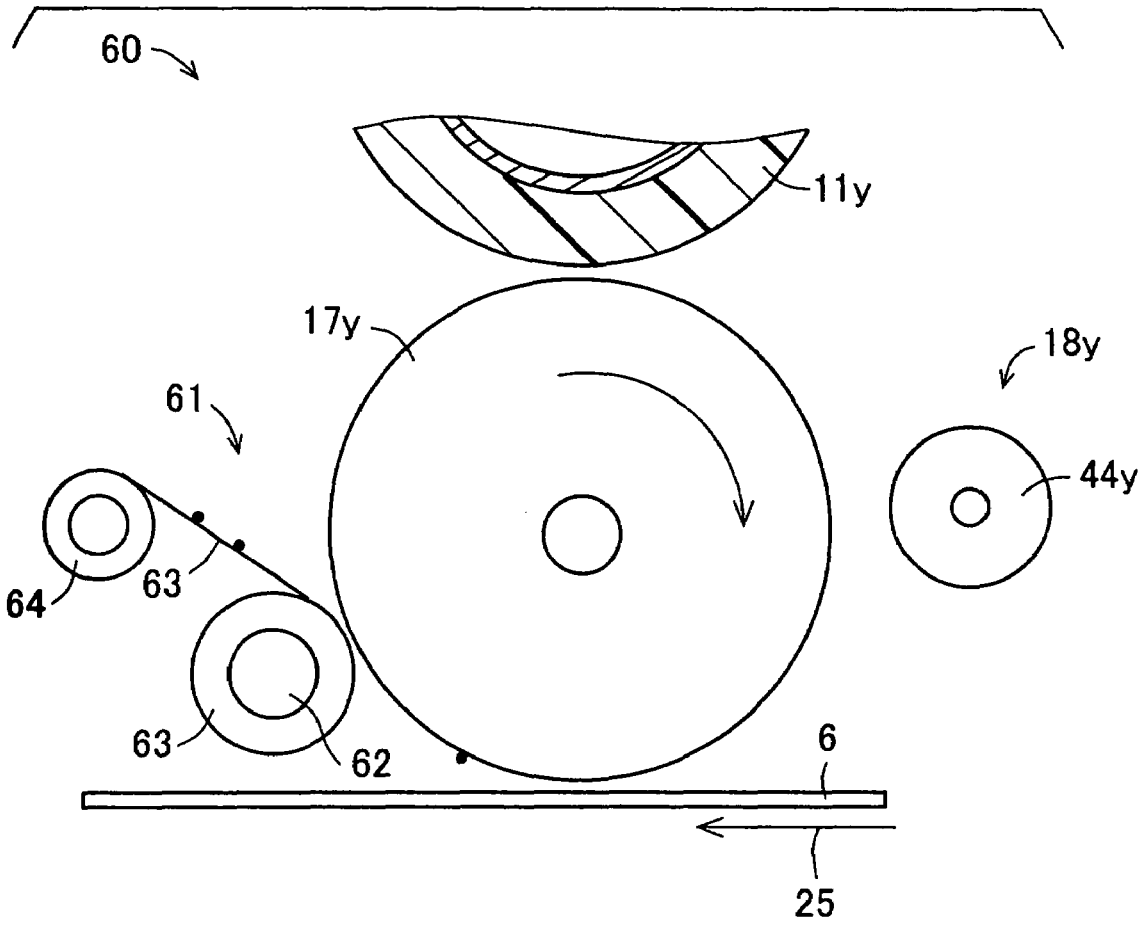
FIG. 8 is a cross-sectional view schematically illustrating the configuration of an image forming apparatus according to a third embodiment of the invention.

FIG. 8 is a cross-sectional view schematically illustrating the configuration of an image forming apparatus 60 according to a third embodiment of the invention. The image forming apparatus 60 is similar to the image forming apparatus 1. Accordingly, corresponding parts are denoted by the same reference numerals or are not shown, and an explanation thereof will be omitted. The image forming apparatus 60 is characterized in that cleaning section 61 serving to clean surfaces of image forming rollers 17*b*, 17*c*, 17*m*, and 17*y* is provided individually for each of the image forming rollers 17*b*, 17*c*, 17*m*, and 17*y*. The cleaning section 61 which is a toner recovering section, includes an unwinding roll 62, a web sheet 63 wound around the unwinding roll 62, and a winding roll 64. The unwinding roll 62 is supported to be rotated around its axis. In addition, the unwinding roll 62 is provided such that the web sheet 63 wound around a corresponding roll is pressed against and in contact with a surface of the image forming roller 17*y* by a contact pressing section (not shown). For example, a spring may be used as the contact pressing section. The unwinding roll 62 causes the web sheet 63 to move toward the winding roll 64 while causing the web sheet 63 to be pressed against and in contact with the surface of the image forming roller 17*y*. The web sheet 63 is pressed against and in contact with the surface of the image forming roller 17*y* and serves to remove the toner 9 remaining on the surface of the image forming roller 17*y*. The winding roll 64 is supported to be rotated around its axis by a driving mechanism (not shown) and winds the web sheet 63 on which the toner 9 is adhered. According to the cleaning section 61, the toner 9 remaining on the surface of the image forming roller 17*y* after the toner image is transferred onto the recording medium 6 is removed by using the web sheet 63 coming into contact with the image forming roller 17*y* and then the web sheet 63 on which the toner 9 is adhered is wound by the winding roll 64. According to the image forming apparatus 60, the surfaces of the image forming rollers 17*b*, 17*c*, 17*m*, and 19*y* are further reliably cleaned. Thus, it is possible to form high-quality images continuously over a long period of time. In the present embodiment, the remaining toner 9 is removed by using the web sheet 63 but is not limited thereto. For example, it is possible to adopt the configuration in which a cleaning blade is in contact with an image forming roller.

Figure 9:
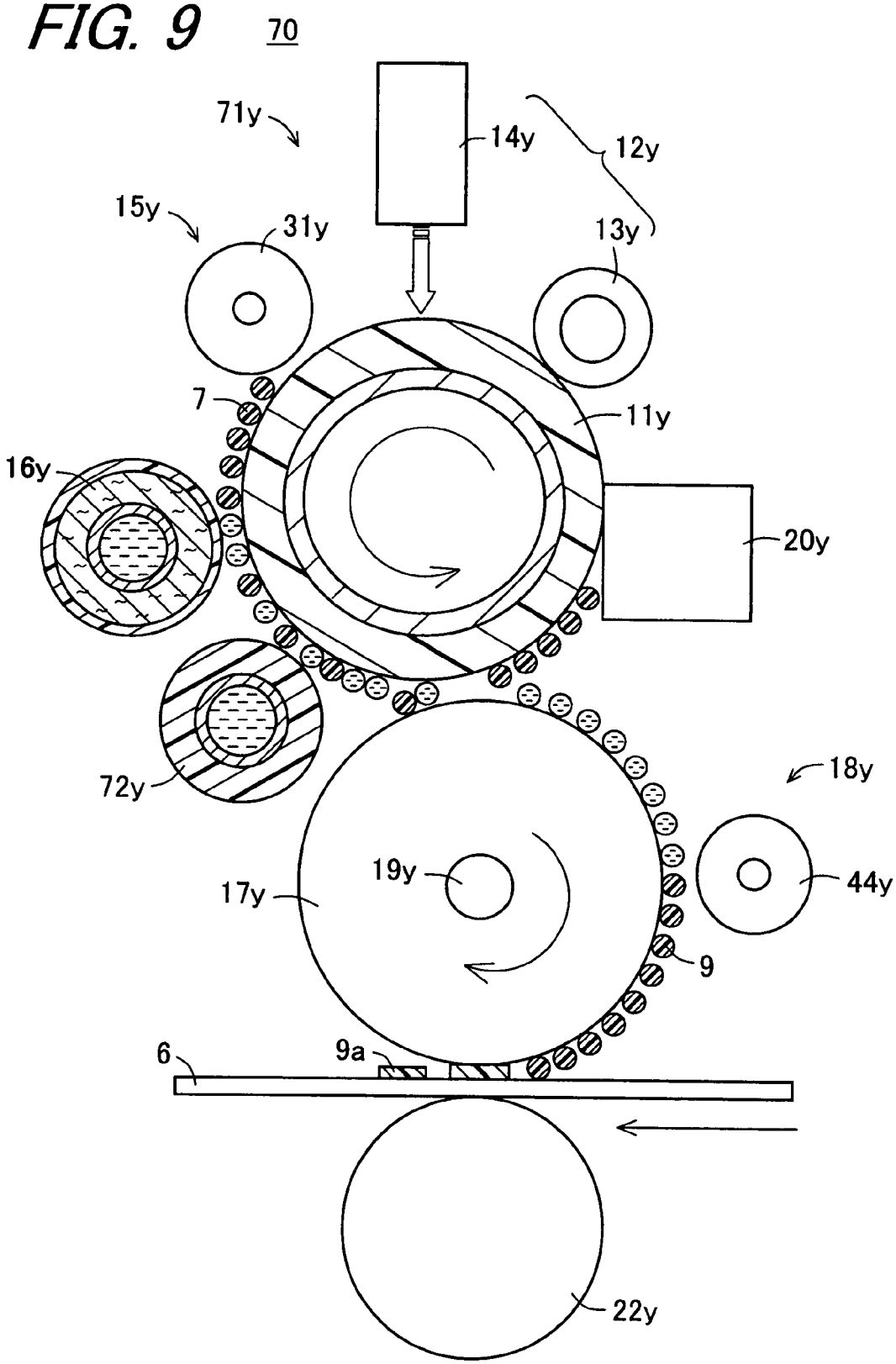
FIG. 9 is a cross-sectional view schematically illustrating the configuration of an image forming apparatus according to a fourth embodiment of the invention.

FIG. 9 is a cross-sectional view schematically illustrating the configuration of an image forming apparatus 70 according to a fourth embodiment of the invention. The image forming apparatus 70 is similar to the image forming apparatus 1. Accordingly, corresponding parts are denoted by the same reference numerals or are not shown, and an explanation thereof will be omitted. The image forming apparatus 70 is characterized in that image forming units 71*b*, 71*c*, 71*m*, and 71*y* (where the image forming units 71*b*, 71*c*, and 71*m* are not shown) are included instead of the image forming units 10*b*, 10*c*, 10*m*, and 10*y* in the image forming apparatus 1. Since the image forming units 71*b*, 71*c*, 71*m*, and 71*y* have the same structure, only the image forming unit 71*y* will hereinafter be described instead of explaining the entire image forming units 71*b*, 71*c*, 71*m*, and 71*y*. The image forming unit 71*y* is characterized in that a fixing fluid recovering section 72*y* is included, the fixing fluid recovering section 72*y* being provided at a downstream side of the fixing fluid supplying section 16*y* in the rotation driving direction of the photoreceptor drum 11*y* and an upstream side of the image forming roller 17*y*. That is to say, the fixing fluid recovering section 72*y* is provided between the fixing fluid supplying section 16*y* and the developing section 18*y*, especially between the fixing fluid supplying section 16*y* and the image forming roller 17*y*. As the fixing fluid recovering section 72*y*, for example, a roller member including a metal core and a foamed sponge layer formed on a surface of the core is used. The inside of the metal core serves as a tank that contains the recovered fixing fluid 8. The metal core is formed with a plurality of through holes, and the recovered fixing fluid 8 flows from the foamed sponge layer to the inside of the metal core through the through holes. As the foamed sponge layer, foamed sponges such as acrylic resins, urethane resins, acrylic rubbers and urethane rubbers are used. In the case when the foamed sponge layer is in contact with a part where the liquid-repellent particles 7 and the fixing fluid 8 on the surface of the photoreceptor drum 11*y* are adhered, the fixing fluid 8 adhered on surfaces of the highly liquid-repellent particles 7 is easily recovered. However, the fixing fluid 8 adhered on the surface of the photoreceptor drum 11*y* whose liquid-repellent property is relatively lower than that of the liquid-repellent particles 7 is not almost recovered. Thus, the fixing fluid 8 that is adhered on the surfaces of the liquid-repellent particles 7 can be recovered even though the amount of the fixing fluid 8 is small, which makes it possible to prevent an image other than a desired image from being formed. In particular, in the case of forming a solid white image, the liquid-repellent particles 7 are condensed in a large area and liquid droplets of the fixing fluid 8 are easy to remain on the surface. Accordingly, in this case, it is preferable to adopt the configuration. When the fixing fluid recovering section 72*y* is provided, the fixing fluid 8 on the surfaces of the liquid-repellent particles 7 can be reliably recovered. In the present embodiment, a roller member (fixing fluid recovering roller) having a foamed sponge layer formed on a surface of a metal core is used as the fixing fluid recovering section 72*y*, but is not limited thereto. For example, a roller member having the same configuration as the fixing fluid supplying section 16*y* may be used under a state in which the fixing fluid 8 is not contained inside the core.

Figure 10:
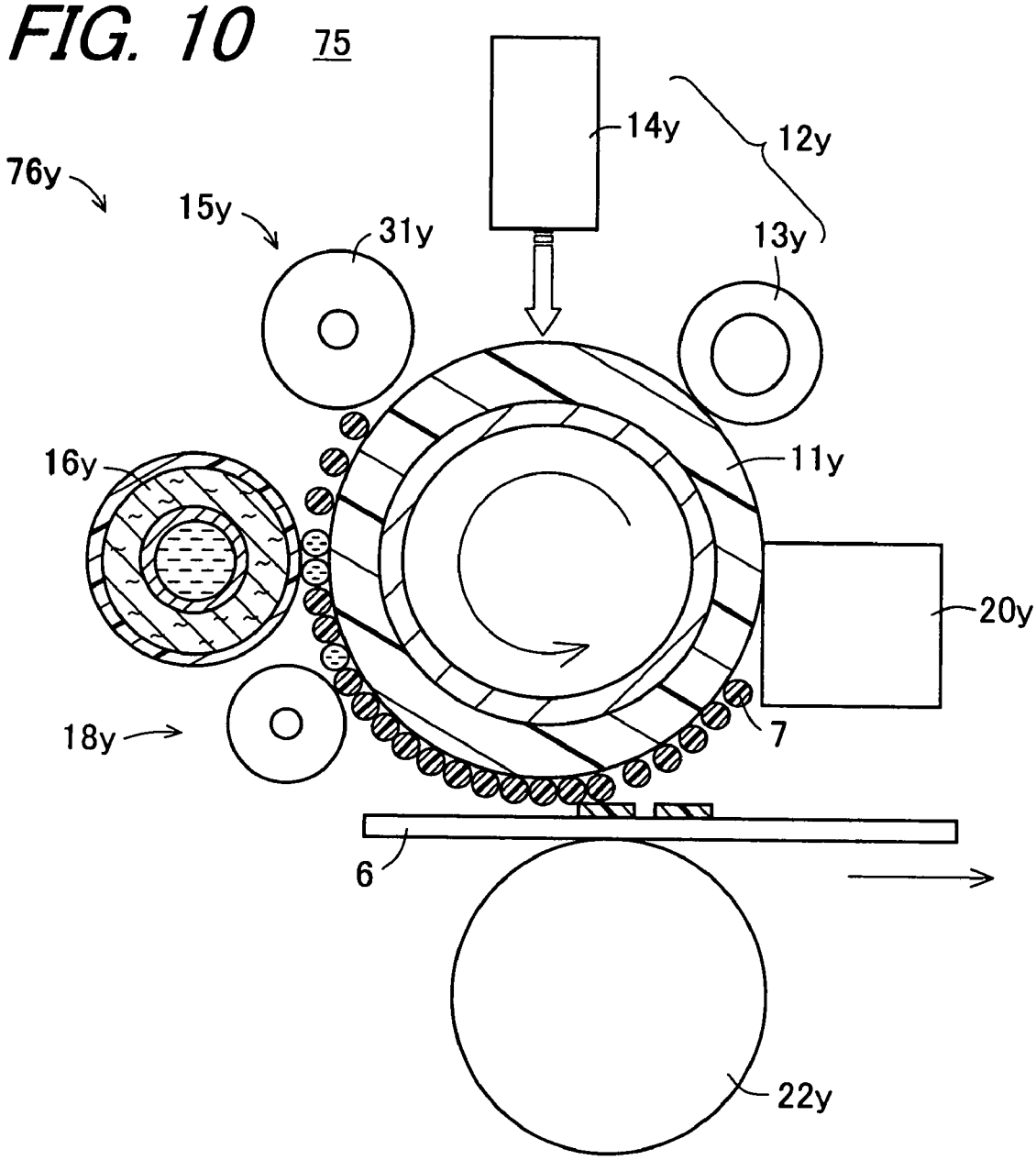
FIG. 10 is a cross-sectional view schematically illustrating the configuration of an image forming apparatus according to a fifth embodiment of the invention.

FIG. 10 is a cross-sectional view schematically illustrating the configuration of an image forming apparatus 75 according to a fifth embodiment of the invention. The image forming apparatus 75 is similar to the image forming apparatus 1. Accordingly, corresponding parts are denoted by the same reference numerals or are not shown, and an explanation thereof will be omitted. The image forming apparatus 75 is characterized in that image forming units 76*b*, 76*c*, 76*m*, and 76*y* (where the image forming units 76*b*, 76*c*, and 76*m* are not shown) are included instead of the image forming units 10*b*, 10*c*, 10*m*, and 10*y* in the image forming apparatus 1. Since the image forming units 76*b*, 76*c*, 76*m*, and 76*y* have the same structure, only the image forming unit 76*y* will hereinafter be described instead of explaining the entire image forming units 76*b*, 76*c*, 76*m*, and 76*y*. The image forming unit 76*y* is characterized in that the image forming roller 17*y* in the image forming unit 10*y* is not included, a toner image is formed on the photoreceptor drum 11*y*, and the toner image is directly transferred from the photoreceptor drum 11*y* onto the recording medium 6 without using the image forming roller 17*y*, thereby forming an image. For this reason, a developing section 18*y* is provided between a downstream side of the fixing fluid supplying section 16*y* and an upstream side of a transfer position (transfer nip part), at which the toner image is transferred onto the recording medium 6, in the rotation direction of the photoreceptor drum 11*y*. A fixing fluid image is formed on a part of an electrostatic latent image by causing the liquid-repellent particles 7 and the fixing fluid 8 to be adhered onto the photoreceptor drum 11*y*. In addition, the toner image is formed by supplying the toner 9 from the developing section 18*y* onto the fixing fluid, the toner 9 swells and softens to become fixable, and the swollen and softened toner 9 is transferred and fixed onto the recording medium 6 at the transfer nip part. Thus, an image is formed.

In the configuration described above, the reason why only the toner 9 is selectively transferred onto the recording medium 6 is as follows. That is, since the swollen and softened toner 9 is in a melt state, an area of the swollen and softened toner 9 being in contact with the recording medium 6 becomes large when the swollen and softened toner 9 is in contact with the recording medium 6. Accordingly, the swollen and softened toner 9 is easily transferred onto the recording medium 6. In contrast, the liquid-repellent particles 7 are solid and are not easily deformed even when the liquid-repellent particles 7 are in contact with the recording medium 6. Accordingly, since an area of the liquid-repellent particles 7 being in contact with the recording medium 6 does not almost change, it is difficult that the liquid-repellent particles 7 are transferred onto the recording medium 6. In principle, only the swollen and softened toner 9 can be transferred onto the recording medium 6 due to the difference. Further, various situations may be considered in connection with a case in which the fixing fluid 8 remains on the liquid-repellent particles 7 and the toner 9 is adhered onto the fixing fluid 8. First, (i) in the case when the amount of the remaining fixing fluid 8 is extremely small, the viscosity of the toner 9 is reduced, and accordingly, there is a little possibility that the toner 9 will be adhered onto the recording medium 6. (ii) In the case when the amount of the adhered toner 9 is larger than that of the remaining fixing fluid 8, the toner 9 being in contact with the recording medium 6 does not swell and soften, and accordingly, there is also a little possibility that the toner 9 will be adhered onto the recording medium 6. (iii) Even in the case when the toner 9 is not adhered onto the remaining fixing fluid 8, there is no possibility that the toner 9 will be adhered onto the recording medium 6. In addition, (iv) in the case when an appropriate amount of toner 9 is adhered with respect to the remaining fixing fluid 8 (in general, when 100 parts by weight of the toner 9 is adhered onto 0.1 to 1 part by weight of the fixing fluid 8), the liquid-repellent particles 7 show the viscosity. Accordingly, there is a possibility that the liquid-repellent particles 7 will be adhered onto the recording medium 6. In the case when there is a high probability that the situation will occur, a bias may be applied between the photoreceptor drum 11*y* and the transfer roller 22*y* in the direction in which the liquid-repellent particles 7 are placed on the photoreceptor drum 11*y*, so that it is possible to suppress the liquid-repellent particles 7 from being adhered onto the recording medium 6. However, in the case when the probability that situations of (i) to (iii) will occur is high, even under the situation of (iv), it is not necessary to apply a bias when power of adhesion of the liquid-repellent particles 7 onto the recording medium 6 is smaller than power of adhesion of the liquid-repellent particles 7 onto the photoreceptor drum 11*y*. In order to obtain the situations of (i) to (iii), it is preferable to adjust a contact angle of the liquid-repellent particles 7 with respect to the fixing fluid 8. The higher the contact angle, the easier the situations of (i) to (iii) are obtained. Accordingly, it is preferable to set the contact angle to be 70° C. or more.

Figure 11:
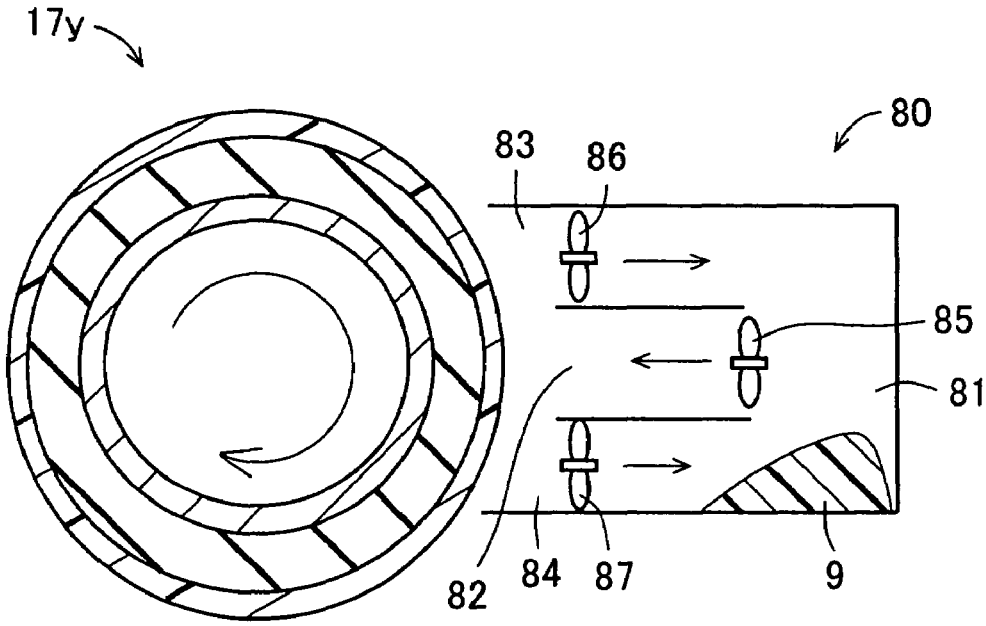
FIG. 11 is a cross-sectional view schematically illustrating the configuration of a developing device having different configuration.

In the image forming apparatuses 1, 51, 60, 70, and 75, the one-component developing device is used as the developing section 18*y* but is not limited thereto. For example, a two-component developing device may be used as the developing section 18*y*. Moreover, in the image forming apparatuses 1, 51, 60, and 70, a developing device 80 shown in FIG. 11 may be used. FIG. 11 is a cross-sectional view schematically illustrating the configuration of the developing device 80 having different configuration. The developing device 80 is a container shaped member having an internal space for storing the toner 9. In addition, the developing device 80 includes a developing tank 81 having a toner supply port 82 and toner recovering ports 83 and 84 formed on a lateral side facing the image forming roller 17*y* in the short-length direction. The developing tank 81 is provided such that ends of upper and lower developing tank walls of the developing tank 81 in the vertical direction thereof are spaced apart from a surface of the image forming roller 17*y* with a gap therebetween, the ends facing the image forming roller 17*y*. In addition, a ventilation fan 85 is provided on an end of the toner supply port 82 not facing the image forming roller 17*y*. The ventilation fan 85 serves to generate airflow flowing from the developing tank 81 toward the image forming roller 17*y* and cause the toner 9 within the developing tank 81 to be supplied and adhered onto fixing fluid image on the surface of the image forming roller 17*y* with the help of the air flow. Furthermore, the toner recovering ports 83 and 84 are formed above and below the toner supply port 82 in the vertical direction thereof, and recovering fans 86 and 87 are provided on ends of the toner recovering ports 83 and 84 facing the image forming roller 17*y*. The recovering fans 86 and 87 serve to generate airflow flowing from the surface of the image forming roller 17*y* toward the inside of the developing tank 81 and recover the toner 9, which scatters around the surface of the image forming roller 17*y* without being adhered on the fixing fluid image, within the developing tank 81. In addition, it is preferable to dispose the plurality of ventilation fans 85 and recovering fans 86 and 87 in the longitudinal direction of the developing tank 81. Thus, the toner 9 can be supplied onto the fixing fluid image without charging the toner 9. Furthermore, in the configuration described above, there is a possibility that the toner 9 will be adhered onto even a part of the image forming roller 17*y* where a fixing fluid image does not exist, but there is no possibility that the toner 9 will swell and soften to show the viscosity. Accordingly, the toner 9 is not substantially transferred onto the recording medium 6. The developing device 80 may be used for the other image forming rollers 17*b*, 17*c*, and 17*m* without being limited to the image forming roller 17*y*.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a toner image forming section for forming a toner image; and a transfer section for transferring the toner image onto a recording medium directly or through an intermediate transfer medium, wherein the toner image forming section includes an image bearing member that bears an electrostatic latent image thereon;

an electrostatic latent image forming section for forming the electrostatic latent image on the image bearing member;

a liquid-repellent particle supplying section for supplying liquid-repellent particles to a region excluding the electrostatic latent image in a region on the image bearing member where the electrostatic latent image is formed, the liquid-repellent particles being particles having a liquid-repellent property with respect to fixing fluid that acts to swell or soften toner;

a fixing fluid supplying section for supplying the fixing fluid to a region corresponding to the electrostatic latent image in the region on the image bearing member where the electrostatic latent image is formed; and a developing section for forming a toner image by supplying toner to a region, to which the fixing fluid is supplied, on the image bearing member.

2. The image forming apparatus of claim 1, wherein the image bearing member is a photoreceptor, and the electrostatic latent image forming section includes a charging section for charging a surface of the photoreceptor, and an exposure section for exposing the surface of the charged photoreceptor to signal light corresponding to image information so as to form an electrostatic latent image.

3. The image forming apparatus of claim 1, wherein the toner image forming section includes a fixing fluid recovering section provided between the fixing fluid supplying section and the developing section, for selectively recovering only fixing fluid adhered onto liquid-repellent particles on the image bearing member.

4. The image forming apparatus of claim 1, wherein the toner image forming section further includes a fixing fluid holding section for holding fixing fluid that is selectively transferred thereonto from the image bearing member, and the developing section causes toner to be supplied to the fixing fluid on the fixing fluid holding section so as to form a toner image.

5. The image forming apparatus of claim 1, wherein the developing section supplies charged toner to the fixing fluid on the image bearing member or the fixing fluid holding section.

6. The image forming apparatus of claim 1, wherein the developing section is provided to be spaced apart from the image bearing member or the fixing fluid holding section with a gap therebetween.

7. The image forming apparatus of claim 4, wherein the fixing fluid holding section includes a drying section for drying fixing fluid on the fixing fluid holding section and toner that is swollen or softened by the fixing fluid.

8. The image forming apparatus of claim 7, wherein the drying section is a heating section for heating the fixing fluid holding section to a temperature equal to or larger than a glass transition temperature of toner.

9. The image forming apparatus of claim 4, wherein the transfer section transfers a toner image formed by toner that is swollen or softened by the fixing fluid on the fixing fluid holding section, onto an intermediate transfer medium or a recording medium, and the toner image forming section includes a toner recovering section for recovering toner remaining on the fixing fluid holding section after transferring the toner image onto the intermediate transfer medium or the recording medium.

10. The image forming apparatus of claim 1, wherein a toner image forming section includes a plurality of image forming units for forming toner images having different colors, and a multi colored image is formed by transferring and overlaying the toner images having different colors which are formed in each image forming unit onto a recording medium or an intermediate transfer medium.

* * * * *